US009102073B2

(12) United States Patent
Tokura

(10) Patent No.: US 9,102,073 B2
(45) Date of Patent: Aug. 11, 2015

(54) APPARATUS PROVIDED WITH CARTRIDGE HOLDER RECEIVING PEN OR CUTTER

(71) Applicant: Masashi Tokura, Konan (JP)

(72) Inventor: Masashi Tokura, Konan (JP)

(73) Assignee: BROTHER KOGYO KABUSHIKI KAISHA, Nagoya-shi (JP)

( * ) Notice: Subject to any disclaimer, the term of this patent is extended or adjusted under 35 U.S.C. 154(b) by 0 days.

(21) Appl. No.: 14/225,016

(22) Filed: Mar. 25, 2014

(65) Prior Publication Data

US 2014/0290507 A1 Oct. 2, 2014

(30) Foreign Application Priority Data

Mar. 26, 2013 (JP) ..... 2013-064007

(51) Int. Cl.
*G06F 15/00* (2006.01)
*B26F 1/38* (2006.01)
*B26D 5/34* (2006.01)

(52) U.S. Cl.
CPC ..... *B26F 1/3813* (2013.01); *B26D 5/34* (2013.01)

(58) Field of Classification Search
CPC ..... H04N 7/173; H04N 21/8456; H04N 5/76; H04N 7/17318; H04N 21/23418; H04N 21/26603; H04N 21/4312; H04N 21/4314; H04N 21/4334; H04N 21/440281; H04N 21/4622; H04N 21/4782; H04N 21/6125; H04N 21/84; G06F 17/241
USPC ..... 358/1.18
See application file for complete search history.

(56) References Cited

U.S. PATENT DOCUMENTS

2005/0186010 A1 8/2005 Shibata et al.
2014/0293376 A1 10/2014 Tokura

FOREIGN PATENT DOCUMENTS

JP 2005-205541 A 8/2005
JP 2014-188603 A 10/2014

*Primary Examiner* — Martin Mushambo
(74) *Attorney, Agent, or Firm* — Fox Rothschild LLP

(57) ABSTRACT

An apparatus includes a cartridge holder configured to receive a pen or a cutter, a first moving mechanism configured to move the cartridge holder in a direction that the cartridge holder comes close to a platen receiving an object, a reading unit configured to read image data from the object, a second moving mechanism configured to move the object to the reading unit, and a processor configured to instruct the apparatus to instruct the first moving mechanism to move the cartridge holder close to the platen, to instruct the second moving mechanism to move the object to the reading unit and the reading unit to read image data to extract, from the image data, a processing mark on the object, to calculate a rotation angle for correcting the image data and to correct, either the image data or processing data, or both the image data and the processing data.

18 Claims, 13 Drawing Sheets

| NUMBER OF PATTERNS | |
|---|---|
| PATTERN A | FIRST COORDINATE DATA<br>SECOND COORDINATE DATA<br>THIRD COORDINATE DATA<br>⋮<br>(N+1)-TH COORDINATE DATA |
| DELIMITER DATA | |
| PATTERN B | FIRST COORDINATE DATA<br>SECOND COORDINATE DATA<br>THIRD COORDINATE DATA<br>⋮<br>(N+1)-TH COORDINATE DATA |
| DELIMITER DATA | |

APPARATUS PROVIDED WITH CARTRIDGE HOLDER RECEIVING PEN OR CUTTER

CROSS-REFERENCE TO RELATED APPLICATIONS

This application is based upon and claims the benefit of priority from the prior Japanese Patent Application No. 2013-064007 filed on Mar. 26, 2013, the entire contents of which are incorporated herein by reference.

BACKGROUND

1. Technical Field

The present disclosure relates to an apparatus provided with a cartridge holder receiving a pen or a cutter and a non-transitory computer-readable medium storing data of instructions for the apparatus.

2. Related Art

Cutting plotters have been conventionally known as an apparatus automatically executing a cutting process. An object to be cut is a sheet-shaped object (paper sheet, for example). The sheet is held on a base material having an adhesive layer on a surface thereof. The sheet is applied to the adhesive layer. The cutting plotter moves the base material holding the sheet, in a first direction while holding both ends of the base material vertically between a driving roller and a pinch roller. The cutting plotter further moves a carriage with a cutting blade in a second direction perpendicular to the first direction. A desired pattern is cut out of the sheet by the above-described operation.

SUMMARY

The cutting plotter has been proposed to be equipped with an image reading device provided with a scanner. In this case, a pattern printed on the sheet is read by the scanner. The pattern is cut out of the sheet based on the read image.

However, when an error is caused between mounting positions of the carriage and the scanner in the above-described cutting plotter, a cutting position of the sheet relative to the pattern is deviated from the pattern. In order that the above-mentioned positional deviation may be prevented, the carriage and the scanner need to be assembled to the cutting plotter with high precision or an adjusting mechanism needs to be provided which adjusts the mounting positions of the carriage and the scanner. These countermeasures result in a high cost.

Therefore, an object of the disclosure is to provide an apparatus which includes an image reading unit to process a sheet-shaped object based on the read image and can realize a high processing precision at low costs, and a non-transitory computer-readable medium storing data of instructions for the apparatus.

The disclosure may provide an apparatus comprising a cartridge holder configured to receive a pen or a cutter, a platen configured to receive an object, a first moving mechanism configured to move the cartridge holder in a direction that the cartridge holder comes close to the platen, a reading unit configured to read image data from the object, a second moving mechanism configured to move the object to the reading unit side, a memory configured to store processing data calculation processing data for moving the first moving mechanism, the processing data serving as instructions to the apparatus and a processor. The processor may be configured to instruct the apparatus to instruct the first moving mechanism to move the cartridge holder close to the platen, based on the calculation processing data, instruct the second moving mechanism to move the object to the reading unit and the reading unit to read image data, after instructing the first moving mechanism to move the cartridge holder close to the platen based on the calculation processing data, extract, from the image data, a processing mark on the object, calculate a rotation angle for correcting the image data, based on the processing mark, and correct, based on the rotation angle, at least one of the image data and the processing data.

The disclosure may also provide a non-transitory computer-readable medium for an apparatus comprising a cartridge holder configured to receive a pen or a cutter, a platen configured to receive an object, a first moving mechanism configured to move the cartridge holder in a direction that the cartridge holder comes close to the platen, a reading unit configured to read image data from the object, a second moving mechanism configured to move the object to the reading unit, and a memory configured to store calculation processing data and processing data for moving the first moving mechanism. The computer-readable medium may store computer-readable instructions, when executed by a processor of the apparatus, cause the apparatus to instruct the first moving mechanism to move the cartridge holder close to the platen, based on the calculation processing data, instruct the second moving mechanism to move the object to the reading unit and the reading unit to read image data, after instructing the first moving mechanism to move the cartridge holder close to the platen based on the calculation processing data, extract, from the image data, a processing mark on the object, calculate a rotation angle for correcting the image data, based on the processing mark, and correct, based on the rotation angle, at least one of the image data and the processing data.

The disclosure may further provide an apparatus comprising a pen or a cutter, a platen configured to receive an object, a first moving mechanism configured to move the pen or the cutter in a direction that the cartridge holder comes close to the platen, a reading unit configured to read image data from the object, a second moving mechanism configured to move the object to the reading unit, a memory configured to store calculation processing data and processing data for moving the first moving mechanism, and a processor. The processor may be configured to instruct the apparatus to instruct the first moving mechanism to move the cartridge holder close to the platen, based on the calculation processing data, instruct the second moving mechanism to move the object to the reading unit and the reading unit to read image data, after instructing the first moving mechanism to move the pen or the cutter close to the platen based on the calculation processing data, extract, from the image data, a processing mark on the object, calculate a rotation angle for correcting the image data, based on the processing mark, and correct, based on the rotation angle, at least one of the image data and the processing data.

DETAILED DESCRIPTION

Figure 1:
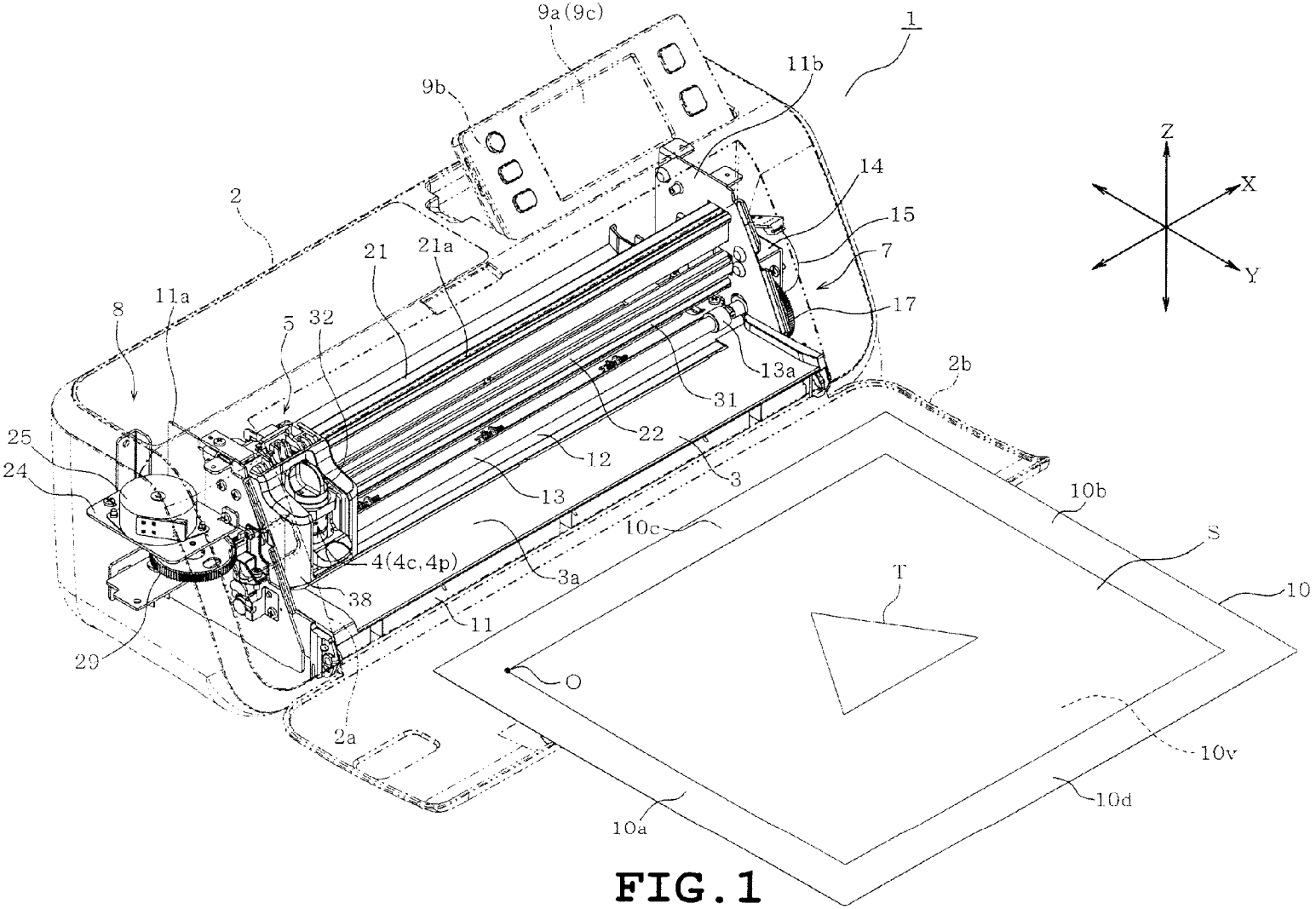
FIG. 1 is an example of a perspective view of a processing apparatus, showing an inner structure thereof and a body cover.

A first example of an apparatus will be described with reference to FIGS. 1 to 15. Referring to FIG. 1, a processing apparatus 1 is shown and includes a body cover 2 serving as a housing, a platen 3 provided in the body cover 2, a processing head 5 on which a cartridge 4 is to be mounted and a scanner 6 (see FIGS. 2 and 6) serving as an image reading unit. The processing apparatus 1 further includes a holding sheet 10 for holding an object S. The object S is to be processed by the processing apparatus 1 or to be read by the image reading unit.

In the processing apparatus 1, a plurality of cartridges 4*c* of a cutter C and a plurality of cartridges 4*p* are prepared as the cartridge 4. One of the cartridges 4*c* and 4*p* is selectively attached to a cartridge holder 32 of a processing head 5 as will be described later. All the cartridges 4*c* and 4*p* include respective cases having substantially the same shape (see cases 50 in FIGS. 4A and 4B). All the cartridges 4*c* and 4*p* will be hereinafter referred to as "cartridge 4" for the sake of simplicity.

The body cover 2 is formed into the shape of a horizontally long rectangular box. The body cover 2 has a front formed with an opening 2*a*. A front cover 2*b* is mounted on the front of the body cover 2 to open and close the opening 2*a*. The holding sheet 10 holding the object S is set onto the platen 3 while the opening 2*a* is open. The cartridge 4 is also attached to and detached from a cartridge holder 32 while the opening 2*a* is open.

The processing apparatus 1 includes a transfer mechanism 7 which transfers the holding sheet 10 set on the platen 3 in a predetermined transfer direction. The processing apparatus 1 also includes a head moving mechanism 8 which moves a processing head 5 in a direction intersecting with the transfer direction of the holding sheet 10 (for example, a direction perpendicular to the transfer direction). In the following description, the direction in which the holding sheet 10 is transferred by the transfer mechanism 7 will be referred to as "front-rear direction". That is, the side of the opening 2*a* of the processing apparatus 1 will be referred to as "front" and the opposite side will be referred to as "rear."

A display 9*a* and an operation switch device 9*b* including various operation switches are mounted on a right upper surface of the body cover 2. The display 9*a* is comprised of a full-color liquid display device and configured as a display unit which displays various patterns, images obtained by the scanner 6, necessary messages to the user, and the like. The operation device 9*b* is operated by the user when various input contents are entered. A touch panel 9*c* is placed on a display surface side of the display 9*a*. The touch panel 9*c* has a transparent matrix touch switch for coordinate input. The touch switch employs a resistance detection system. More specifically, the touch switch is configured of resistors arranged in a matrix at predetermined intervals. When the user touches any position on the touch switch with his/her finger, a point of intersection of the resistors corresponding to the touched position is scanned, whereby the touch position is detected. When operating the operation switches of the operation switch device 9*b* or the touch panel 9*c*, the user can designate an object to be displayed on a screen of the display 9*a*, select various patterns, switch various operation modes and set various parameters.

Figure 2:
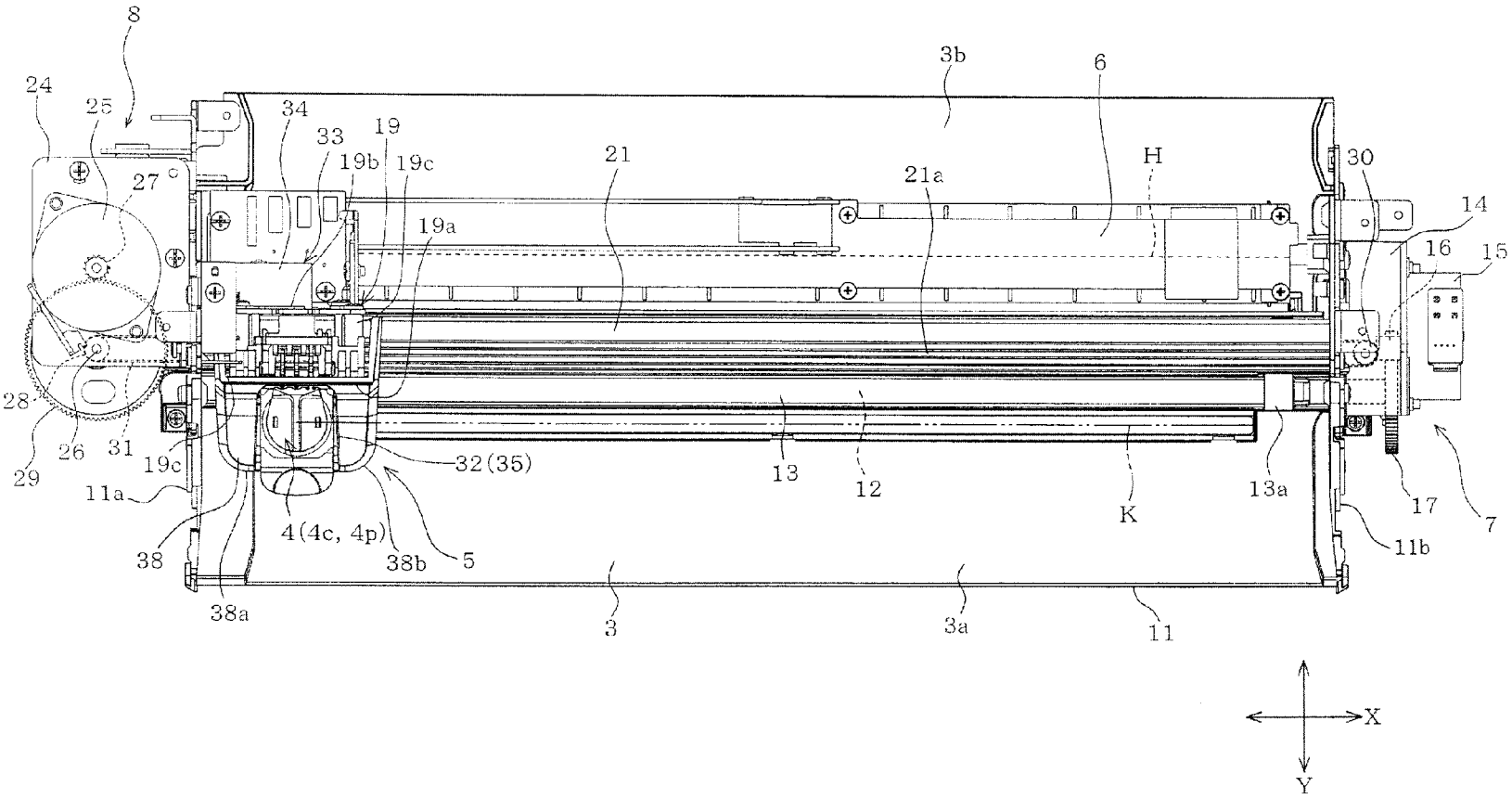
FIG. 2 is an example of a plan view of the processing apparatus, showing the inner structure thereof.

The platen 3 receives the underside of the holding sheet 10 when the object S is processed. The platen 3 includes a front platen 3*a* and a rear platen 3*b* and has a horizontal upper surface as shown in FIG. 2. The holding sheet 10 holding the object S is transferred while being placed on the platen 3. The holding sheet 10 is made of a synthetic resin material and formed into a rectangular sheet shape. The holding member 10 has an upper surface including peripheral edges 10*a* to 10*d* and an inner region to which an adhesive agent is applied thereby to be formed into an adhesive layer 10*v* (see FIG. 1). The user affixes the object S to the adhesive layer 10*v* with the result that the object S is held by the holding sheet 10. The adhesive layer 10*v* has an adhesive force which is set so that the object S is immovably held reliably in the cutting by the cutter C or the printing by the pen P and so that the object S can be easily removed after the processing. The transfer mechanism 7 and the head moving mechanism 8 are constructed into a relative movement unit which moves the holding sheet 10 holding the object S in the X direction and the processing head 5 in the Y direction relative to each other.

Firstly, the transfer mechanism 7 transfers the holding sheet 10 on the upper surface side of the platen 3 freely in the Y direction. A frame 11 is enclosed in the body cover 2 as shown in FIGS. 1 and 2. The frame 11 includes right and left sidewalls 11*b* and 11*a* which are located at right and left sides of the platen 3 so as to face each other, respectively. A driving roller 12 and a pinch roller 13 are mounted on both sidewalls 11*a* and 11*b* so as to be located in a space between the front and rear platens 3*a* and 3*b*. The driving roller 12 and the pinch roller 13 extend in the right-left direction and lined in the up-down direction. The pinch roller 13 is located above the driving roller 12.

The driving roller 12 has an upper end which is substantially level with the upper surface of the platen 3 and right and left ends mounted on the right and left sidewalls 11*b* and 11*a* respectively so that the driving roller 12 is rotatable. The right end of the driving roller 12 extends rightward through the right sidewall 11*b* as shown in FIG. 2. A driven gear 17 having a large diameter is secured to a right distal end of the driving roller 12. A mounting frame 14 is fixed to an outer surface of the right sidewall 11*b*. A Y-axis motor 15 comprised of a stepping motor, for example is mounted on the mounting frame 14. The Y-axis motor 15 has an output shaft to which is fixed a driving gear 16 which has a small diameter and is to be brought into mesh engagement with the driven gear 17.

The pinch roller 13 has right and left ends mounted on the right and left sidewalls 11*b* and 11*a* respectively so that the pinch roller 13 is rotatable and slightly displaceable in the up-down direction. Two springs (not shown) are mounted on the outer surfaces of the right and left sidewalls 11*b* and 11*a* to normally bias the pinch roller 13 downward. Accordingly, the pinch roller 13 is normally biased downward (to the driving roller 12 side) by the springs. Two rollers 13*a* having a slightly large diameter are mounted on the pinch roller 13 so as to be located near both ends thereof respectively. Only the right roller 13*a* is shown in FIGS. 1 and 2.

The right and left ends 10*b* and 10*a* of the holding sheet 10 are thus held between the driving roller 12 and the rollers 13*a* of the pinch roller 13. Upon drive of the Y-axis motor 15, normal or reverse rotation of the Y-axis motor 15 is transmitted via the gears 16 and 17 to the driving roller 12, whereby the holding sheet 10 is transferred rearward or forward together with the object S. The transfer mechanism 7 is thus constituted by the driving roller 12, the pinch roller 13, the Y-axis motor 15 and the gears 16 and 17 serving as a reduction mechanism.

The head moving mechanism 8 serves to move the carriage 19 of the processing head 5 freely in the X direction. More specifically, as shown in FIGS. 1 and 2, a pair of guide rails 21 and 22 are fixed to the right and left sidewalls 11*b* and 11*a* so as to be located slightly rear above the pinch roller 13. The guide rails 21 and 22 extend in the right-left direction substantially in parallel to the pinch roller 13. Guide grooves are formed in an upper surface of the guide rail 21 and an underside of the guide rail 22 so as to extend between the right and left ends although only the guide groove 21*a* of the upper surface is shown.

Furthermore, the carriage 19 has a pair of protrusions engaging the guide grooves 21*a* and 21*b* respectively although the grooves are not shown. The protrusions are formed on the upper and lower sides so as to hold the guide grooves 21*a* therebetween in the up-down direction. Thus, the carriage 19 is supported by the engagement of the protrusions and the guide grooves 21*a* so as to be slidable on the guide rails 21 and 22 in the right-left direction.

A horizontal mounting frame 24 is fixed to the outer surface of the left sidewall 11*a* so as to be located near the rear of the left sidewall 11*a* at the outer surface side, as shown in FIGS. 1 and 2. An X-axis motor 25 is mounted on a rear part of the left mounting frame 24 to a downward direction. Furthermore, a vertically extending pulley shaft 26 (see FIG. 2) is mounted on the mounting frame 24. The X-axis motor 25 is comprised of a stepping motor, for example and has an output shaft to which a driving gear 27 having a small diameter is fixed. A timing pulley 28 and a driven gear 29 having a large diameter are rotatably mounted on the pulley shaft 26. The timing pulley 28 and the driven gear 29 are configured to be rotated together.

On the other hand, a timing pulley 30 is mounted on the right mounting frame 14 so as to be rotatable about an axis extending in the up-down direction. An endless timing belt 31 horizontally extends between the timing pulleys 30 and 28 in the right-left direction. The timing belt 31 has a midway part joined to a mounting part (not shown) of the processing head 5.

Upon drive of the X-axis motor 25, normal or reverse rotation of the X-axis motor 25 is transmitted via the gears 27 and 29 and the timing pulley 28 to the timing belt 31, whereby the processing head 5 is moved leftward or rightward together with the carriage 19. Thus, the carriage 19 is moved freely in the right-left direction perpendicular to the direction in which the object S is conveyed. The head moving mechanism 8 is thus constituted by the guide rails 21 and 22, the X-axis motor 25, the gears 27 and 29 serving as a reduction mechanism, the timing pulleys 28 and 30, the timing belt 31 and the like.

Figure 3:
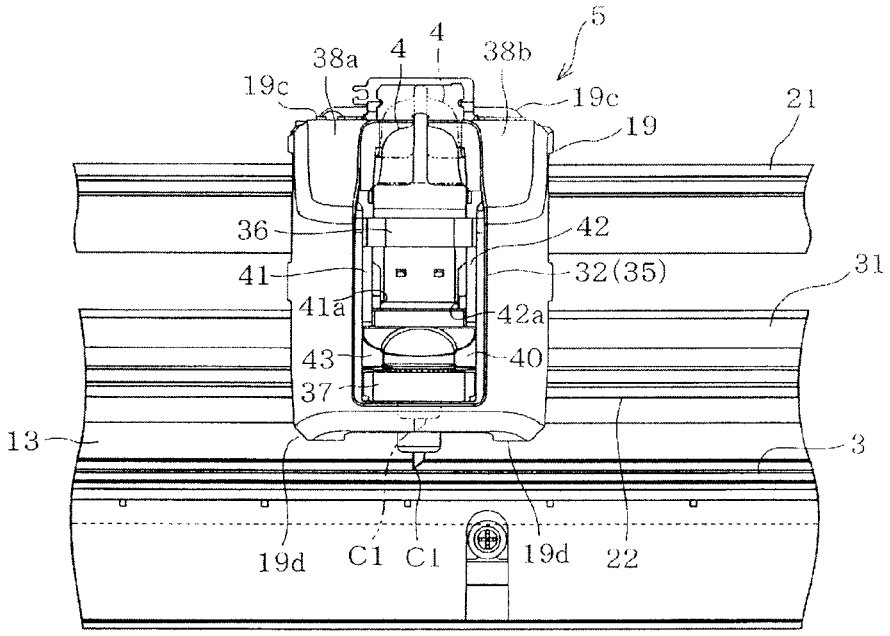
FIG. 3 is an example of a front view of a processing head and its periphery.
Figure 5:
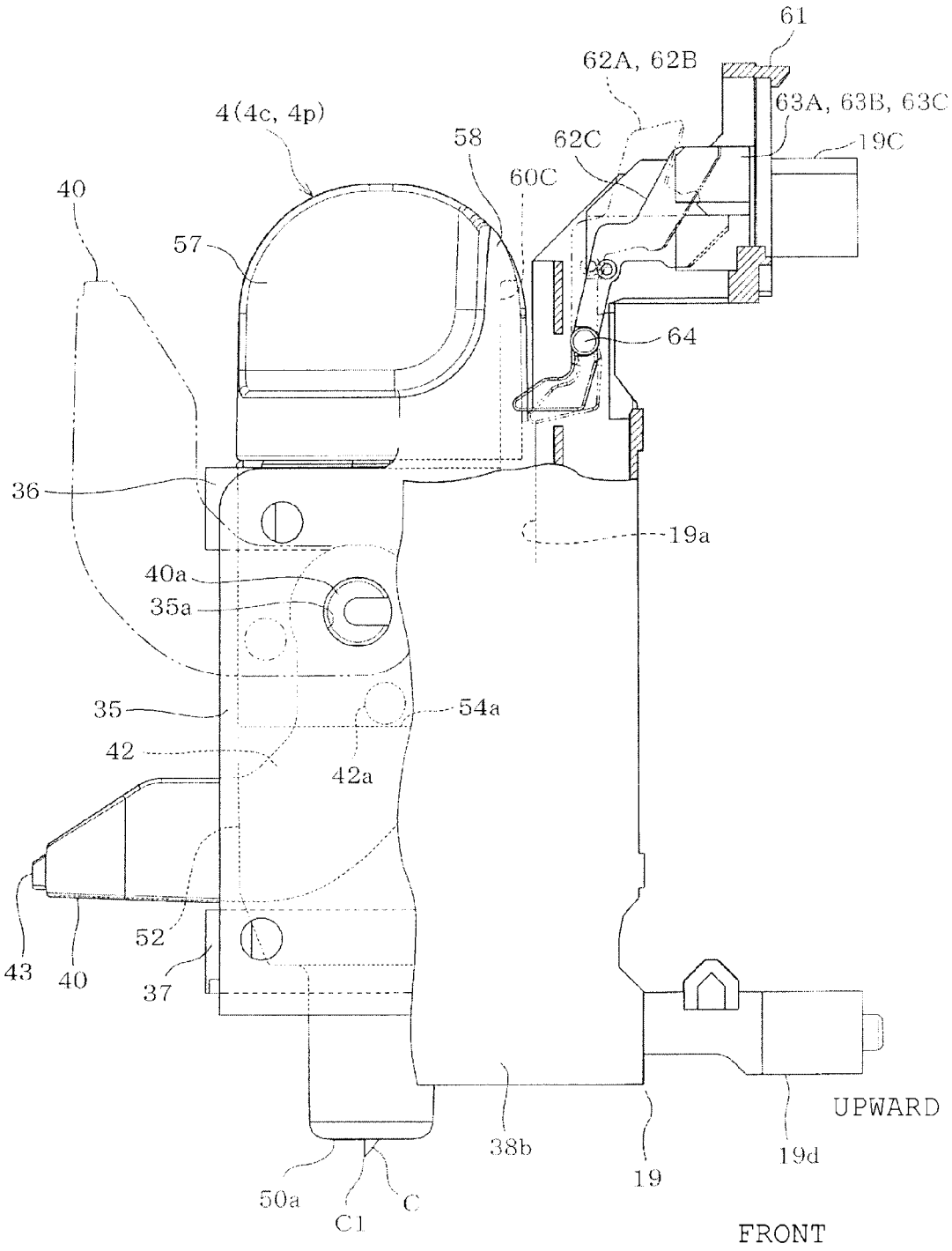
FIG. 5 is an example of a right side view of a cartridge holder and its vicinity with a cover member being partially broken in the state where the cartridge is attached.

The processing head 5 includes an up-down drive mechanism 33 and a cartridge holder 32 disposed in the rear and in front of the carriage 19 as shown in FIG. 2. The up-down drive mechanism 33 is configured to drive the cartridge holder 32 in the up-down direction (the Z direction) together with the cartridge 4. The carriage 19 includes front and rear walls 19*a* and 19*b* and upper and lower arms 19*c* and 19*d* connecting the walls 19*a* and 19*b*, as shown in FIGS. 2, 3 and 5. Thus, the carriage 19 is shaped so as to surround the front and rear sides and upper and lower sides of the guide rails 21 and 22. A Z-axis motor 34 (see FIG. 2) is mounted so that art axis thereof is directed frontward. The Z-axis motor 34 is comprised of a stepping motor, for example. A transmission mechanism (not shown) is provided between the Z-axis motor 34 and the cartridge holder 32. The transmission mechanism reduces a rotational speed of the Z-axis motor 34 and converts rotation of the Z-axis motor 34 to up-down movement of the cartridge holder 32, transmitting the up-down movement. The transmitting mechanism and the Z-axis motor 34 constitute an up-down drive mechanism 33.

Figure 4A:
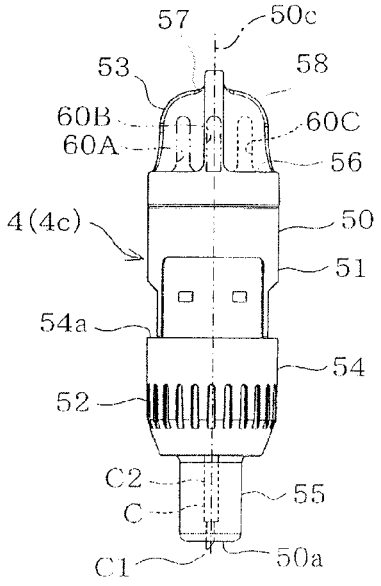
FIGS. 4A and 4B are examples of front views of examples of a cutter cartridge and a pen cartridge respectively.
Figure 4B:
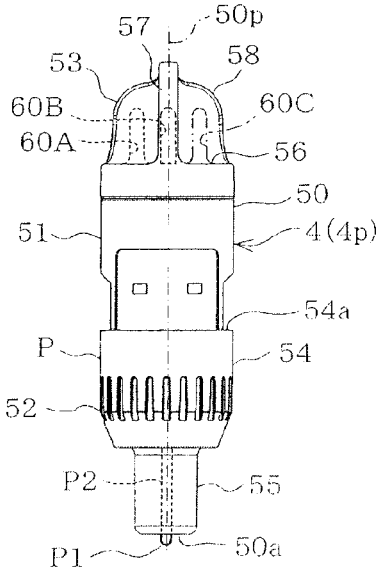

Upon drive of the Z-axis motor 34, normal or reverse rotation of the Z-axis motor 34 is converted via the transmission mechanism to the up-down movement, whereby the cartridge holder 32 is moved upward or downward together with the cartridge 4. As a result, the cartridge holder 32 is moved together with the cartridge 4 between a lowered position and a raised position. When located at the lowered position, the cartridge 4 of the cartridge holder 32 carries out cutting by a cutter C or printing by a pen P as shown in FIGS. 4A and 4B. When the cartridge 4 of the cartridge holder 32 is located at the raised position, the blade edge C1 or the pen tip P1 is spaced away from the object S by a predetermined distance (see two-dot chain line in FIG. 3).

When the cartridge 4*c* of the cutter C is attached to the cartridge holder 32 and is located at the lowered position, the blade edge C1 penetrates the object S. Pressure of the blade edge C1 for the cutting in this case will be referred to as "cutter pressure." On the other hand, when the cartridge 4*p* of the pen P is attached to the cartridge holder 32 and is located at the lowered position, the pen tip P1 abuts on the object S. Pressure of the pen tip P1 for the cutting in this case will be referred to as "pen pressure." The cutter pressure and the pen pressure are set to pressure values suitable for the cutting and the printing by a control circuit 71 based on an amount of rotation of the Z-axis motor 34, respectively.

The cartridge holder 32 includes a holder frame 35 and upper and lower holders 36 and 37 as shown in FIGS. 2, 3 and 5. The holder frame 35 is driven upward and downward by the up-down drive mechanism 33. The upper and the lower holders 36 and 37 are fixed to the holder frame 35. More specifically, a cover member 38 is provided on the front wall 19*a* of the carriage 19 so as to cover right and left sides of the front wall 19*a* from front. The holder frame 35 serving as movable part is disposed between a left projection part 38*a* and a right projection 38*b* of the cover member 38. The holder frame 35 is formed into a C-shape (see FIG. 2) and has a top, underside and front all of which are open. The upper and lower holders 36 and 37 are attached so that the cartridge 4 is inserted through the both holders from above. The upper and lower holders 36 and 37 are each formed into a frame shape housed in the holder frame 35.

The holder frame 35 is provided with a lever member 40 located between the upper and the lower holders 36 and 37 as shown in FIGS. 3 and 5. The lever member 40 has a pair of right and left arms 41 and 42 and an operating portion 43 which is provided so as to connect between distal end sides of the arms 41 and 42. Furthermore, the lever member 60 has a proximal end formed with pivot portions 40*a* and 40*b* located at outer surface sides of the arms 41 and 42 respectively. Only the right pivot portion 40*a* is shown in FIG. 5. The holder frame 35 has right and left sidewalls formed with circular holes respectively. Only right circular hole 35*a* is shown. The pivot portions 40*a* and 40*b* are inserted through circular holes 35*a* respectively. The arms 41 and 42 include respective inner surface sides provided with small columnar engagement portions 41*a* and 42*a* (see FIGS. 3 and 5). The engagement portions 41*a* and 42*a* are formed so as to be engageable with engaged portions 54*a* of the cartridge 4 respectively.

As a result, the lever member 40 is swung about the pivot portions 40*a* serving as a center of swinging motion so as to be switchable between an open position shown by alternate long and two short dashes line in FIG. 5 and a fixed position show by solid line in FIG. 5. As shown in FIG. 5, the engagement portions 41*a* and 42*a* engage the engaged portions 54*a* respectively when the lever member 40 is located at the fixed position. As the result of the engagement, the cartridge 4 is fixed to the lower holder 37 (the cartridge holder 32). On the other hand, when operated so as to be pulled frontward, the lever member 40 is swung from the fixed position to the open position. With this swing, the engagement portions 41*a* and 42*a* depart from the respective engaged portions 54*a*, whereby the lever member 40 is released from the fixed state.

The cartridge 4 which is detachably attached to the cartridge holder 32 will now be described. FIGS. 4A and 4B exemplify cartridges 4*c* and 4*p* of the cutter C and the pen P respectively. As shown, the cartridge 4*c* of the cutter C and the cartridge 4*p* of the pen P include the same case 50 and are selectively attached to the cartridge holder 32. More specifically, the case 50 includes a case body 51, the cap 52 and a knob 53. The cap 52 and the knob 53 are provided on one end and the other end of the body 51 respectively. The case body 51 is formed into a cylindrical shape and extends in the up-down direction.

The cap 52 includes a larger-diameter portion 54 and a smaller-diameter portion 55 and is accordingly formed into the shape of a stepped bottomed cylindrical container. The larger-diameter portion 54 is fitted with a lower end of the case body 51. The larger-diameter portion 54 has an upper end serving as an engaged portion 54*a* which abuts on the engagement portions 41*a* and 42*a* of the lever member 40. The larger-diameter portion 54 has a lower end which is fitted with the lower holder 37 of the cartridge holder 32. The cap 52 has an underside 50*a* formed into a flat shape. The underside 50*a* has a through hole (not shown) through which the blade edge C1 of the cutter C or the pen tip P1 is inserted. The knob 53 has a cover plate 56, a knob plate 57 and a rear plate 58 both provided on an upper part of the cover plate 56. The cover plate 56 is fixed to an upper end of the case body 51. The knob plate 57 is mounted on a central part of the cover plate 56 in the right-left direction so as to be directed vertically.

The cartridge 4*c* shown in FIG. 4A includes the cutter C serving as a cutting unit. The cutter C has a proximal end or a cutter shaft C2 and a distal end (a lower end) or the blade edge C1, both of which are formed integrally with the cutter C. The cutter shaft C2 is formed into a round bar shape and is housed in the case 50. The blade of the cutter C is formed into a substantially triangular shape tilted relative to the object S although not shown in detail in the drawings. Furthermore, bearings are provided in the case body 51 to support the cutter shaft C2 so that the cutter shaft C2 is rotatable about a central axis 50*c* thereof. The blade edge C1 protrudes from the underside 50*a* of the cap 52. The cartridge 4*c* is constructed so that a central axis 50*c* of the cutter shaft C2 corresponds with a central axis of the cap 52.

On the other hand, the cartridge 4*p* shown in FIG. 4B is a printing instrument formed into the pen P and has a distal end or the pen tip P1 from which ink is caused to seep. An ink tank (not shown) is provided in the case body 51 to supply ink to a pen tip member P2. The pen tip P1 protrudes from the underside 50*a* of the cap 52. The cartridge 4*p* is constructed so that a central axis 50*p* of the pen tip P1 corresponds with a central axis of the cap 52.

Any one of three grooves 60A to 60C is formed in the rear plate 58 of the knob 53 so that the rear plate 58 is a concavo-convex portion, as shown in FIGS. 4A and 4B. The grooves 60A to 60C have different concavo-convex patterns according to types of the cartridges 4. More specifically, for example, the cutting cartridge 4*c* or the printing cartridge 4*p* can be discriminated based on presence or absence of the groove 60C at the right end of the rear plate 58, as shown in FIGS. 4A and 4B. In other words, for example, the cartridges 4*c* and 4*p* as shown in respective FIGS. 4A and 4B differ from each other in the presence or absence of the groove 60C at the right end of the rear plate 58. The groove 60C can discriminate between the cutting cartridge 4*c* and the printing cartridge 4*p*. Furthermore, for example, the color type of the pen P can be discriminated based on presence or absence of the grooves 60A and 60B of the cartridge 4*p*.

The carriage 19 is provided with a detection unit which is located at an upper side facing the rear plate 58 of the cartridge 4, as shown in FIG. 5. The detection unit may include, for example, three contacts 62A to 62C and three type detection sensors 63A to 63C all provided on a substrate holder 61.

The type detection sensors 63A to 63B mounted on a substrate of the substrate holder 61 so as to be arranged from side to side. The type detection sensors 63A to 63C are comprised of optical sensors (photointerrupters). The contacts 62A to 62C are formed into the shape of a plate extending over the side of the type detection sensors 63A to 63C. The contacts 62A to 62C have lengthwise middle portions formed with shafts 64 respectively. The substrate holder 61 is provided with bearings (not shown) swingably supporting the shafts 64 respectively. The contacts 62A to 62C are supported by the respective bearings so as to be lined in the direction of plate thickness. Three extension coil springs (not shown) extend between upper portions of the contacts 62A to 62C and the substrate holder 61 respectively. The contacts 62A to 62C are biased by the extension coil springs in a direction such that the upper portions of contacts 62A to 62C are tilted toward the type detection sensors 63A to 63C respectively. In other words, the biasing forces of the extension coil springs act in a direction such that lower ends of the contacts 62A to 62C come into contact with the rear plate 58 of the knob 53.

For example, when the cartridge 4*c* of the cutter C is attached to the cartridge holder 32, the lower ends of the contacts 62A and 62B come into contact with the rear plate 58, thereby swinging. With the swinging, the upper ends of the contacts 62A and 62B are departed from the type detection sensors 63A and 63B respectively (see two-dot chain line in FIG. 5). On the other hand, the lower end of the other contact 62C remains tilted toward the groove 60C of the rear plate 58. Accordingly, the upper end of the contact 62C is fitted at the type detection sensor 63C side.

The cartridge 4*c* of the cutter C is attached to the cartridge holder 32 in cutting the object S. In this case, the control circuit 71 identifies the type of the cartridge 4*c*, based on detection signals of the contacts 62A to 62C generated by the type detection sensors 63A to 63C respectively. The control circuit 71 then controls the up-down drive mechanism 33 to move the cartridge 4*c* to the lowered position and sets the blade edge C1 to the above-mentioned cutter pressure. In this case, the blade edge C1 penetrates the object S on the holding sheet 10 to be put slightly into the holding sheet 10. In this state, the holding sheet 10 and the cartridge 4*c* (the cutter C) are moved in the X and Y directions relative to each other by the transfer mechanism 7 and the head moving mechanism 8, respectively. The cutting of the object S is executed by this relative movement.

On the other hand, the cartridge 4*p* of the pen P is attached to the cartridge holder 32 in printing the object S. In this case, the control circuit 71 identifies the type of the cartridge 4*p*, based on detection signals of the contacts 62A to 62C generated by the type detection sensors 63A to 63C respectively. The control circuit 71 then controls the up-down drive mechanism 33 to move the cartridge 4*p* to the lowered position and sets the pen tip P1 to the above-mentioned pen pressure. In this case, the pen tip P1 penetrates the object S. In this state, the holding sheet 10 and the cartridge 4*p* (the pen P) are moved in the X and Y directions relative to each other by the transfer mechanism 7 and the head moving mechanism 8, respectively. The printing of the object S is executed by this relative movement. An X-Y coordinate system with a left corner of the adhesive layer 10*v* serving as an origin O is set in the processing apparatus 1, as shown in FIG. 1. The above-described relative movement of the holding sheet 10 (the object S) and the processing head 5 (the cutter C or the pen P) is carried out on the basis of the X-Y coordinate system.

The processing apparatus 1 according to the example is provided with a scanner 6 serving as an image obtaining unit shown in FIG. 2. The scanner 6 is comprised of a contact image sensor (CIS), for example. The scanner 6 includes a line sensor including a plurality of image pickup devices lined in the right-left direction, a light source (a lamp) and lens, all of which are composed integrally. The scanner 6 has a length substantially the same as the width of the holding sheet 10 and extends in the right-left direction. The scanner 6 is disposed in the rear of the guide rail 22 and directed downward. The scanner 6 has an underside having a read part which reads an image on the surface of the object S while being in proximity to the upper surface of the object S.

The scanner 6 is controlled by the control circuit 71. More specifically, the control circuit 71 controls the transfer mechanism 7 to move the holding sheet 10 rearward or in the Y direction. The control circuit 71 controls the scanner 6 so that a reading operation by the scanner 6 (scanning in the X direction) is repeatedly executed in synchronization with the movement of the holding sheet 10. The control circuit 71 obtains two-dimensional image data of the object S by the above-described control manner. The carriage 19 has an underside provided with a sheet detection sensor 76 (see FIG. 6). The sheet detection sensor 76 detects a distal end position of the holding sheet 10 set on the platen 3 and accordingly a y-position of the holding sheet 10. A detection signal generated by the sheet detection sensor 76 is supplied to the control circuit 71.

Furthermore, the control circuit 71 is configured to process the image data of the object S read by the scanner 6 in a known image processing manner. In this case, the control circuit 71 extracts shapes, colors of patterns affixed to the object S, and the like. Based on data of the extracted pattern shapes, pattern colors and the like, the control circuit 71 controls the display 9*a* and generates cutting or printing data of the patterns. A coordinate system of the image data is specified so as to correspond to the X-Y coordinate system of the processing apparatus 1.

Figure 6:
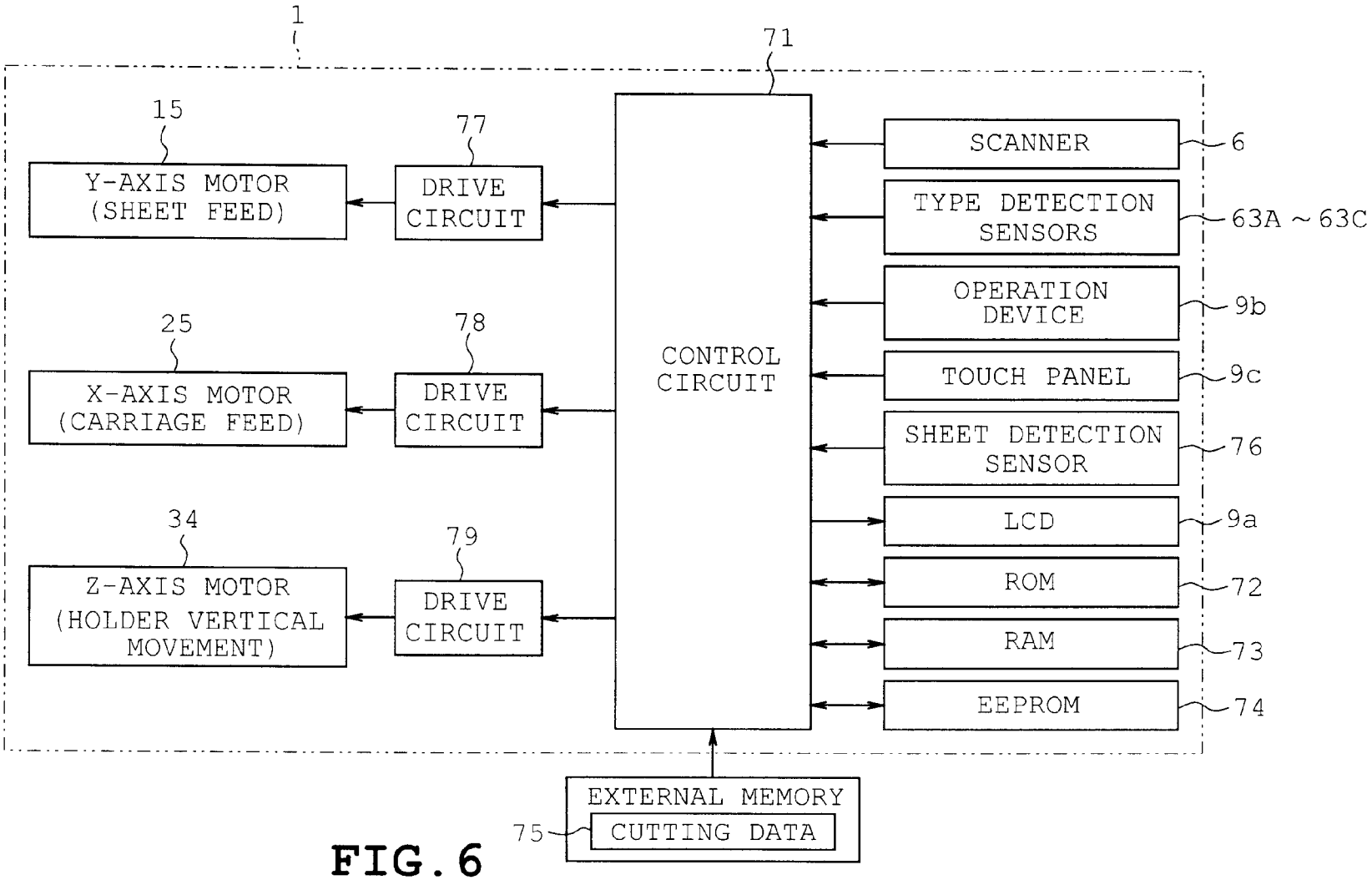
FIG. 6 is an example of a schematic block diagram showing an electrical configuration of the apparatus.

The control system of the processing apparatus 1 will be described with reference to FIG. 6. The control circuit 71 is an example of a processor controlling the entire processing apparatus 1. The control circuit 71 is mainly configured of a computer (CPU). The computer may be an example of a processor. The CPU (central processing unit) may be also an example of a processor. The control circuit 71 are connected to a ROM 72, a RAM 73, an EEPROM 74 and an external memory 75. The ROM 72 stores a cutting control program, a printing control program, a display control program, a cutting data generation program, a printing data generation program, a data processing program which will be described later. The cutting control program is provided for controlling a cutting operation. The printing control program is provided for controlling a printing operation. The display control program is provided for a displaying operation of the display 9*a*. The cutting data generation program is provided for generating cutting data based on the above-mentioned image data. The printing data generation program is provided for generating printing data based on the image data. The external memory 75 stores the cutting data and the printing data. The cutting data is provided for cutting a plurality of types of patterns. The printing data is provided for printing a plurality of types of patterns.

Signals are supplied to the control circuit 71 from the sheet detection sensor 76, the type detection sensors 63A to 63C, the scanner 6 and the like. To the control circuit 71 are connected the display 9*a*, the touch panel 9*c* and various operation switches of the operation device 9*b*. While viewing a display screen of the display 9*a*, the user operates various switches of the operation device 9*b* or the touch panel 9*c*. As a result, the user can select a desired pattern and set various processing modes and parameters. To the control circuit 71 are further connected drive circuits 77, 78 and 79 driving the Y-axis motor 15, the X-axis motor 25 and the Z-axis motor 34, and the like. Based on the cutting or printing data, the control circuit 71 controls the Y-axis motor 15, the X-axis motor 25, the Z-axis motor 34 and the like so that a cutting or printing operation is automatically executed for the object S on the holding sheet 10.

Figures 7, 8A, 8B:
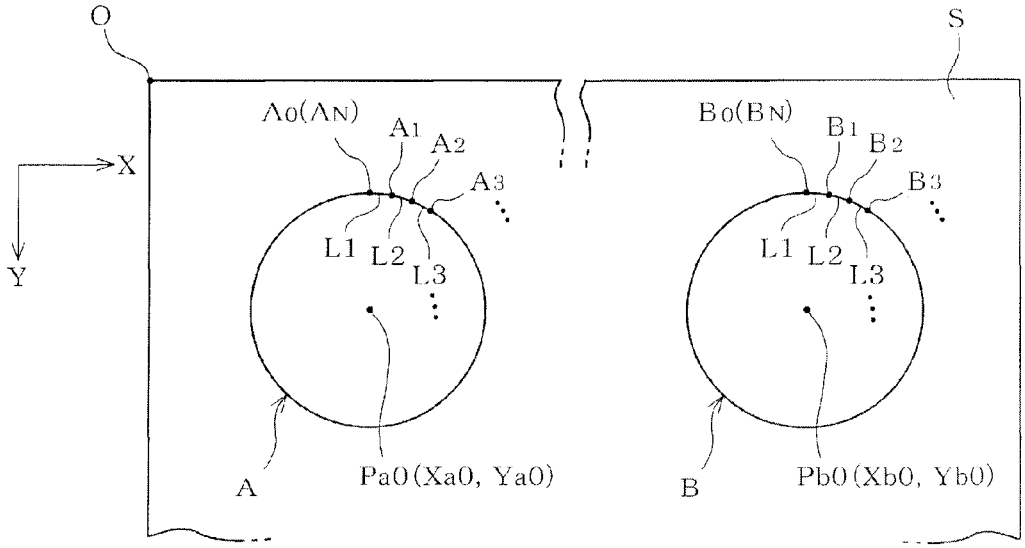
FIG. 7 illustrates an example of a structure of processing data.
FIGS. 8A and 8B illustrates an example of a pattern to which processing is applied based on processing data.
Figure 10:
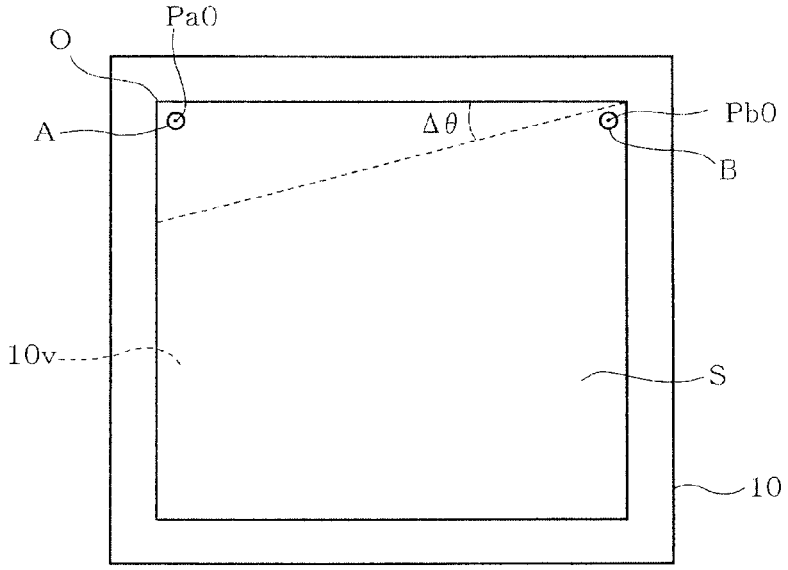
FIG. 10 is a plan view of an object held by the holding member together with machining marks.

The cutting data will be described with an exemplified case where two patterns as shown in FIG. 10 are cut out of the object S held on the holding sheet 10. More specifically, a pattern A of "circle" located at a rear left corner of the object S and a pattern B of "circle" located at a rear right corner of the object S are to be cut by the cutter C. The full data in this case includes the number of patterns that is data of total number of patterns, cutting line data, delimiter data and display data as shown in FIG. 7. In the case as shown in FIG. 10, the number of patterns is two since the patterns A and B are involved. The cutting line data is set for each pattern. The cutting line data is data of coordinate values indicative of X-Y coordinates of apexes of a cutting line composed of a plurality of line segments. The data of coordinate values is defined by the X-Y coordinate system of the processing apparatus 1.

In more detail, FIG. 8A shows an enlarged cutting line of the pattern A. The cutting line of the pattern A is composed of line segments L1, L2, L3, . . . connecting among a cutting start point $A_0$, apex $A_1$, apex $A_2$, . . . and cutting end point $A_N$ on a circumference thereof. The cutting line is rendered substantially circular as a whole by setting an inter-apex distance to a small value. The cutting start point $A_B$ and the cutting end point $A_N$ correspond with each other. The cutting line data has first coordinate data, second coordinate data, third coordinate data, . . . (N+1)-th coordinate data corresponding to the cutting start point $A_0$, apex $A_1$, apex $A_2$, . . . and cutting end point $A_N$ respectively.

A cutting line of a pattern B as shown in FIG. 8B is also composed of line segments L1, L2, L3, . . . connecting among a cutting start point $B_0$, apex $B_1$, apex $B_2$, . . . and cutting end point $B_N$ on a circumference thereof in the same manner as the cutting line of the pattern A. The cutting line is rendered substantially circular as a whole by setting an inter-apex distance to a small value. The cutting line data has first coordinate data, second coordinate data, third coordinate data, . . . (N+1)-th coordinate data corresponding to the cutting start point $B_0$, apex $B_1$, apex $B_2$, . . . and cutting end point $B_N$ respectively. The patterns A and B are congruent with each other, that is, have the same shape and the same size. The patterns A and B also have the same y-cutting position. In other words, Y coordinate ($Ya_0$) of the center point $Pa_0$ of the pattern A corresponds with Y coordinate ($Yb_0$) of the center point $Pb_0$ of the pattern B ($Ya_0$=$Yb_0$).

The control circuit 71 instructs to execute a cutting operation to cut the pattern A and pattern B in this order, based on the above-described cutting data. More specifically, firstly, the cutter C is relatively moved to the X-Y coordinates of the cutting start point $A_0$ by the transfer mechanism 7 and the head moving mechanism 8. Next, the blade edge C1 of the cutter C is caused to penetrate through the part of the cutting start point $A_0$ of the object S by the up-down moving mechanism 33. In this state, the transfer mechanism 7 and the head moving mechanism 8 are driven so that the cutter C is relatively moved in such a manner as to connect the apexes A1, A2, A3, . . . sequentially by straight lines. Thus, the line segments L1, L2, L3, . . . are cut sequentially continuously, whereby the cutting line of the circular pattern A is cut.

The other pattern B is also cut on the basis of the cutting line data thereof in the same manner as described above. Delimiter data is suffixed to the cutting line data of both patterns A and B. Furthermore, based on the delimiter data suffixed to each cutting line data, the blade edge C1 of the cutter C is departed from the object S by the up-down drive mechanism 33 every time the cutting of cutting line is finished.

The printing data will be described with an exemplified case where the above-mentioned patterns A and B are printed on the object S. The printing data includes printing line data, color data, delimiter data and display data although none of the data is shown. More specifically, as shown in FIGS. 8A, 8B and 10, the patterns A and B are printed at rear corners of the object S by the pen P, whereby the "circle" composed of the line segments L1, L2, L3, . . . is drawn. Printing line data of each of the patterns A and B includes line segment data corresponding to the line segments L1, L2, L3, . . . . Each line segment data has coordinate data in which start and end points of the corresponding line segments are indicated by X-Y coordinates. Color data represents a type of color of the pen P and is set for each pattern so as to correspond to printing line data.

In the printing, the cartridge 4*p* of the pen P of the relevant type is displayed on the display 9*a* on the basis of the color data. The user attaches the cartridge 4*p* to the cartridge holder 32 while viewing displayed contents on the display 9*a*. The control circuit 71 executes the above-described printing operation and relatively moves the pen P based on the printing line data, whereby the line segments L1 . . . are plotted sequentially in this order. As a result, the patterns A and B are printed for every color. Delimiter data is suffixed to the printing line data of the patterns A and B respectively. The pen tip P1 is departed from the object S by the up-down drive mechanism 33 every time the plotting of one pattern is completed on the basis of the delimiter data.

The ROM 72 and the external memory 75 store the cutting and printing data of various types of patterns including the patterns A and B. The cutting data and the printing data will be referred to as "processing data" in the following description. Furthermore, the cutting operation and the printing operation will be referred to as "processing operation."

Two-dot chain line K in FIG. 2 shows an x-movement locus of the center axis of the cartridge 4. The two-dot chain line K represents a moving range (processing position of the processing head 5) of the cutter C or the pen P. Furthermore, broken line H in FIG. 2 shows a sequence location of imaging devices. The two-dot chain line K and the broken line H are set to such a positional relation as to be parallel to each other with a predetermined distance therebetween. In more detail, the two-dot chain line K and the broken line H extend in the X direction in parallel to each other. Actually, however, there is a case where error occurs between locations of the scanner 6 and the head moving mechanism 8 due to differences in the dimensions of constructional elements of the processing apparatus 1. More specifically, there is a case where error occurs in an inter-distance and/or parallelism between the two-dot chain line K and the broken line H.

Figure 16A:
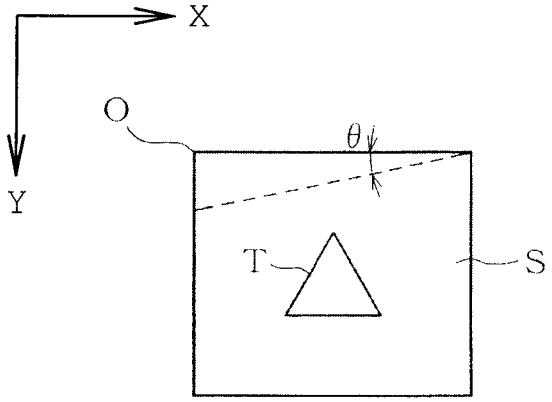
FIGS. 16A to 16D are schematic diagrams showing the object to which a pattern is attached and a course of correcting the read screen inclined Δθ.

For example, assume now that the scanner 6 is assembled in a state where an array direction of imaging devices (a main scanning direction) along broken line H in FIG. 2 is slightly inclined relative to the X direction. More specifically, assume that the array direction of the imaging devices is deviated by angle Δθ relative to the X direction, as shown in FIGS. 10 and 16A with somewhat exaggeration. In this case, as shown in FIG. 168, an image T displayed on the display 9*a* based on image data obtained by the scanner 6 is inclined by angle Δθ. Furthermore, cutting data of an image to be generated based on the image data indicates coordinate data of a cutting line which is also inclined by angle Δθ relative to a line of a pattern T of an actual object S. In the same way, printing data to be generated based on the image data indicates coordinate data of a printing line which is inclined by angle Δθ relative to the line of the pattern T.

Assume that the array of the imaging devices is deviated from a normal position in the X or Y direction without angular deviation of array direction of the imaging devices. In this case, x-error Δx and y-error Δy (see FIG. 11) influence display of the pattern T on the display 9*a* and processing of the pattern T, resulting in deviation (see FIGS. 13A and 13B). On the other hand, although the scanner 6 is assembled at the normal position, the errors Δθ, Δx and Δy occur when the guide rails 21 and 22 of the head moving mechanism 8 are assembled so as to be deviated relative to the X direction.

Furthermore, assume that an actual length in the array direction of the imaging devices (array length) has an assembly error ΔL. In this case, image data of the object S is generated so as to be reduced or expanded in the X direction relative to the actual object S.

Accordingly, the control circuit 71 calculates a difference between an actual relative position of the processing position by the processing head 5 and the array position of the imaging devices and a set relative position. Furthermore, the control circuit 71 is configured to correct image data and processing data based on the calculated difference. The set relative position refers to a relative position between the processing position and the array position when the processing position by the processing head 5 and the array position of the imaging devices are normal. More specifically, the set relative position is a relative position between the processing position and the array position when there are no errors Δθ, Δx, Δy and ΔL described above. The actual relative position is a relative position between the processing position and the array position when there is at least one of the errors Δθ, Δx, Δy and ΔL.

When calculating the difference between the actual and set relative positions in the correcting mode, the control circuit 71 executes a cutting operation based on calculation processing data (cutting data of patterns A and B, for example). As a result, image data of cutting line of the object S is obtained by the reading operation of the scanner 6 after cutting lines of patterns A and B have been formed regarding the object S. The control circuit 71 then calculates a difference between X-Y coordinates of center points $Pa_1$ and $Pb_1$ (see FIG. 128) of images AI and BI of the patterns A and B indicated by the obtained image data and X-Y coordinates of the original center points $Pa_0$ and $Pb_0$ of the cutting data. The following first correction data to third correction data are obtained according to the calculated difference.

The first correction data is used to carry out inclination correction with the angle Δθ serving as the difference (correction angle). The angle Δθ is made between the movement direction of the processing head 5 of the head moving mechanism 8 and the array direction of the imaging devices. The second correction data is used to carry out correction for parallel displacement in the X and Y directions with x-error Δx and y-error Δy serving as differences. The x-error Δx and y-error by are obtained between the movement direction of the processing head 5 of the head moving mechanism 8 and the array direction of the imaging devices. The third corrected data is used to carry out correction by variable power in the array direction with respect to the error ΔL which is a difference between an actual array length in the array direction of the imaging devices of the scanner 6 and a set length L (see FIG. 11).

Figure 9:
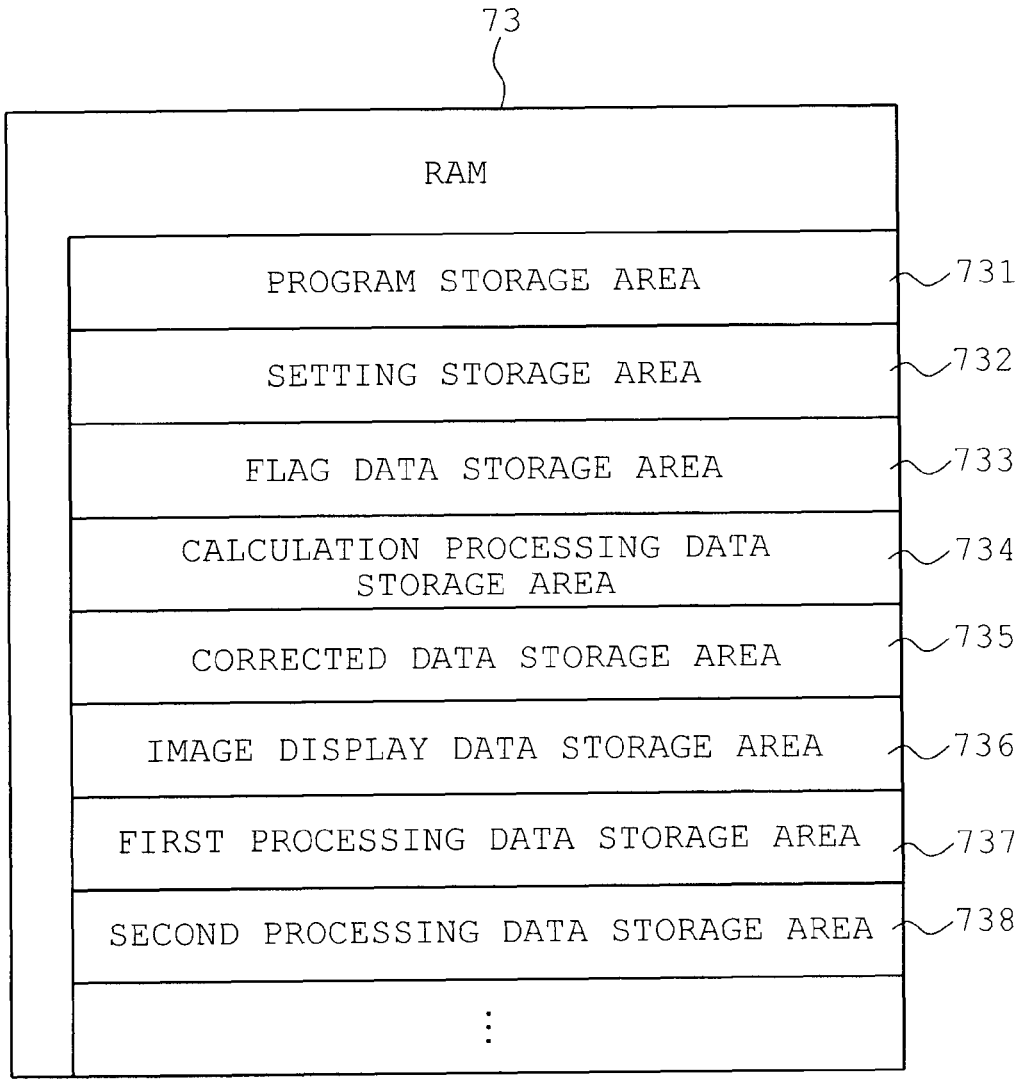
FIG. 9 illustrates an example of storage area of the RAM.

The RAM 73 has storage areas to temporarily store various data. Date stored in the RAM 73 includes the above-described programs, processing data, settings entered by the switches of the operation device 9*b* and the results of calculation by the control circuit 71. In more detail, as shown in FIG. 9, the RAM 73 has a plurality of storage areas including a program storage area 731, a setting storage area 732, a flag data storage area 733, a calculation processing data storage area 734, a correction data storage area 735, an image display data storage area 736, a first processing data storage area 737 and a second processing data storage area 738. The program storage area 731 stores various programs read from the ROM 72 and the like. The setting storage area 732 stores set values, tables and the like all of which are referred to in the execution of the programs. The flag data storage area 733 stores various flags used in execution of the program.

The calculation processing data storage area 734 stores calculation processing data used in a correcting mode. The correction data storage area 735 stores first to third corrected data calculated in the correcting mode. The image display data storage area 736 stores image data and display setting of screens displayed on the display 9*a*. The first processing data storage area 737 stores cutting data and printing data in the case where processing is executed based on the original processing data. The second processing data storage area 738 stores cutting data and printing data generated based on the image data.

Figure 14:
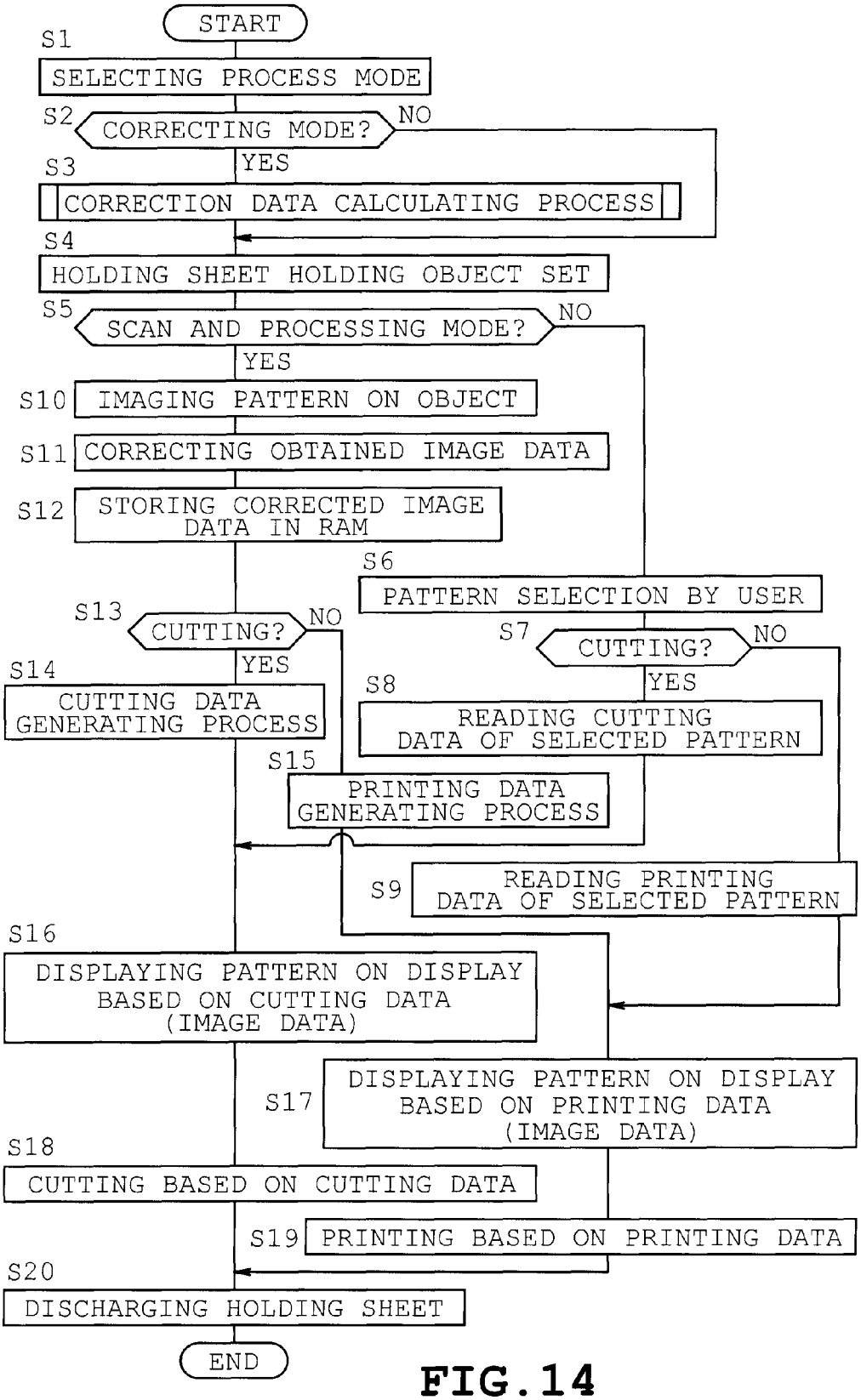
FIG. 14 illustrates an example of a flowchart showing processing on the data correction program and a sequence of processing.
Figure 15:
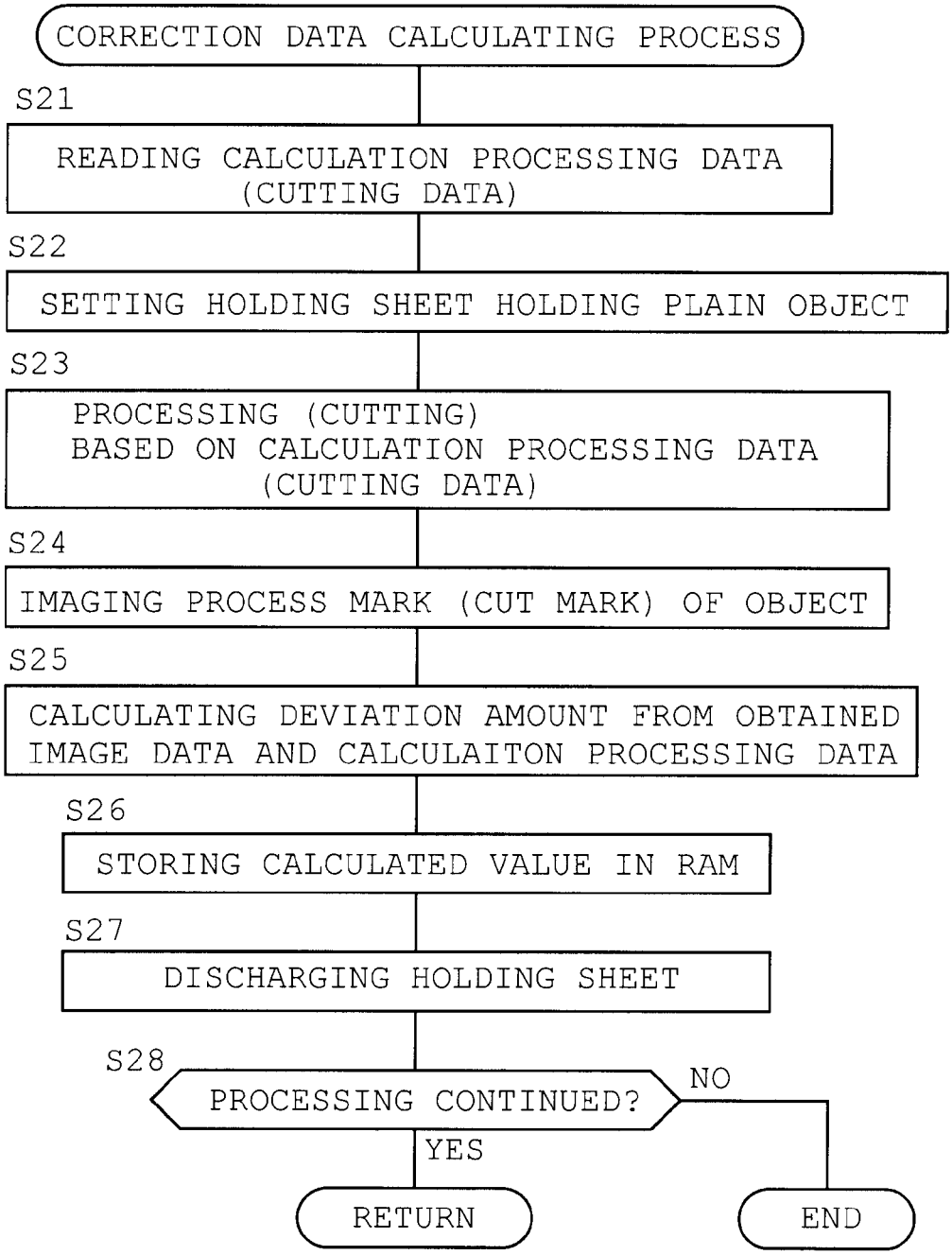
FIG. 15 is a flowchart showing a corrected data calculating process.

The operation of the processing apparatus 1 will be described with reference to FIGS. 14 and 15. FIG. 15 is a flowchart showing processing on a data correcting program and a sequence of processing both executed by the control circuit 71. A processing mode, a scan and processing mode and a correcting mode will be described in the following. Processing is executed based on the original processing data in the processing mode. The object S with a pattern is processed in the scan and processing mode. First to third correction data are obtained by calculation and a correcting process is carried out on the basis of the obtained first to third correction data.

Firstly, the user causes the display 9*a* to display a setting screen (a processing mode selecting screen). The user further touches the touch panel 9*c* to select the mode and a processing manner in the mode (the cutting or the printing). When the processing mode is selected (NO at step S2), the user sets the holding sheet 10 affixed with the object S on the platen 3 of the processing apparatus 1 (step S4). In this case, the control circuit 71 instructs a sheet detection sensor 76 to detect the distal end of the holding sheet 10. Based on the detection of the holding sheet 10, the control circuit 71 sets the left corner of the adhesive layer 10*v* of the holding sheet 10 to an origin O. Furthermore, in the processing mode (NO at step S5), a pattern selecting screen is displayed on the display 9*a*. The user touches the touch panel 9*c* to select a desired pattern (step S6).

When the cutting has been selected at step S1 (YES at step S7), cutting data of the corresponding pattern is read from the external memory 75 to be loaded into the first processing data storage area 737 of the RAM 73 (step S8). On the other hand, when the printing has been selected (NO at step S7), printing data of the corresponding pattern is read from the external, memory 75 to be loaded into the first processing data storage area 737 (step S9). Furthermore, the control circuit 71 instructs the display 9*a* to display the selected pattern on a suitable scale, based on the cutting or displaying data (steps S16 and S17).

Assume that the control circuit 71 determines that the cartridge 4 of the type pertaining to the cutting or printing of the pattern is not attached, based on detection signals of the three type detection sensors 63A, 63B and 63C and the processing data read at step S8 or S9. In this case, the control circuit 71 instructs the display 9*a* to display the above determination. The user then attaches the cartridge 4 of the pertaining type to the cartridge holder 32. The user further switches the lever member 40 from an open position to a fixed position, whereby the cartridge 4 is fixed (see FIG. 5).

The control circuit 71 identifies the type of the cartridge 4 based on the detection signals of the type detection sensors 63A to 63C. When receiving the instruction to start processing by the operation of the switch of the operation device 9*b*, the control circuit 71 executes a cutting operation on the basis of cutting data of the selected pattern (step S18) or a printing operation on the basis of printing data of the selected pattern (step S19). When finishing the cutting of the pattern from the object S or the printing of the pattern on the object S, the control circuit 71 instructs the transfer mechanism 7 to transfer the holding sheet 10 forward to discharge the holding sheet 10 (step S20). The control circuit 71 completes the process with discharge of the holding sheet 10.

The scan and processing mode is carried out to process the object S provided with a pattern T as shown in FIG. 1, for example. Accordingly, for example, when the scanner 6 has the above-described error Δθ, Δx, Δy, ΔL of the assembly position, a processing position of the object S is deviated from the pattern T. In view of the deviation, when the correcting mode is selected at step S1, the correcting data calculating process is executed (YES at step S2, and step S3).

In a correcting data calculating process shown in FIG. 15, the control circuit 71 reads, for example, cutting data of the patterns A and B from the ROM 72, loading the read data into the calculation processing data storage area 734 of the RAM 73 (step S21). The user sets the holding sheet 10 affixed with, for example, white paper serving as a plain object S on the platen 3 of the processing apparatus 1 (step S22). In this case, the control circuit 71 instructs the sheet detection sensor 76 to detect the distal end of the holding sheet 10, whereby the origin O of the holding sheet 10 is set. When determining that the cartridge 4 of the cutter C is attached, based on the detection signals of the type detection sensors 63A to 63C, the control circuit 71 executes a cutting operation on the basis of the cutting data of the patterns A and B (step S23).

As a result, the object S is formed with cutting lines of the patterns A and B, as shown in FIG. 10. Subsequently, the control circuit 71 instructs the transfer mechanism 7 to move the holding sheet 10 in the Y direction. The control circuit 71 then instructs the scanner 6 to repeatedly carrying out a reading operation (scanning in the X direction) in synchronization with the movement of the holding sheet 10 (step S24). The control circuit 71 processes the image data of a cutting mark on the object S read by the scanner 6, by a known image processing technique. The control circuit 71 further obtains X-Y coordinates of the center lines from the image data of the images AI and BI of the patterns A and B (see FIG. 12B). In this case, the control circuit 71 extracts X-Y coordinates of center lines Pa1 and Pb1 of a circular shape according to the algorithm of Hough transform. Algorithm known in image processing library such as Open CV can be employed as the Hough transform. The control circuit 71 then calculates correction data based on the X-Y coordinates of the center lines $Pa_1$ and $Pb_1$ extracted from the image data and X-Y coordinates of the original center points $Pa_0$ and $Pb_0$ at the reference set position (step S25).

In this case, the control circuit 71 calculates first correction data when determining that the Y coordinates of the center points $Pa_1$ and $Pb_1$ do not correspond with each other, the control circuit 71 ($Ya_1 \neq Yb_1$; and see FIG. 128). In this regard, Y coordinate of the center point $Pa_0$ of the pattern A and Y coordinate of the center point $Pb_0$ of the pattern B correspond with each other ($Ya_0 = Yb_0$). Accordingly, an angle $\Delta\theta$ is made by an imaginary line segment 101 connecting between the center points $Pa_1$ and $Pb_1$ and an imaginary line segment 100 connecting between the center points $Pa_0$ and $Pb_0$. The angle $\Delta\theta$ is calculated from the following equation (1):

$$\tan \Delta\theta = (Yb_1 - Ya_1)/(Xb_1 - Xa_1) \quad (1)$$

Figure 16B:
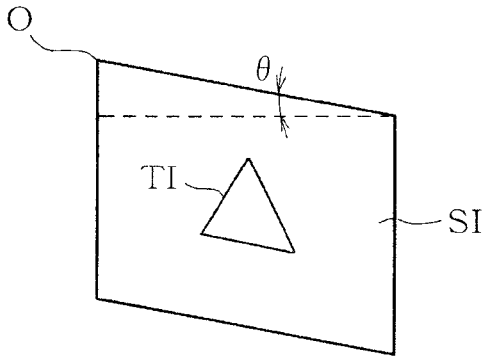
Figure 16C:
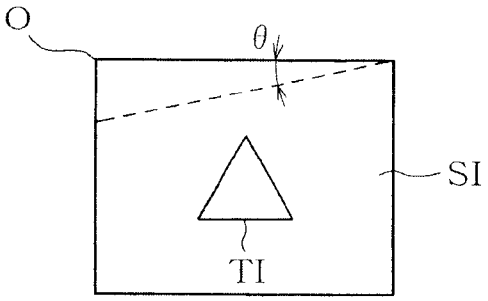
Figure 16D:
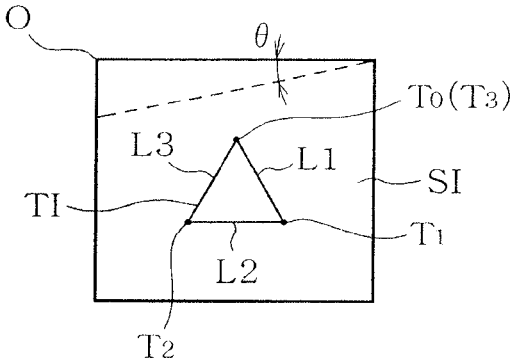

The control circuit 71 instructs the RAM 73 to store tan $\Delta\theta$ as a transformed value in the correction data storage area 735. The transformed value corresponds to first correction data used in an affine transform to transform a parallelogram image SI in FIG. 16B to a rectangular image SI in FIG. 16C. Furthermore, in order that the scale changed by the reading operation in the state inclined by $\Delta\theta$ may be corrected, the image SI in FIG. 16C is enlarged by cos $\Delta\theta$-fold thereby to be fitted to the size of the object S (see FIG. 16D). The transform value (scale factor of cos $\Delta\theta$) used in the affine transform is also stored as the first correction data in the correction data storage area 735 (step S26).

Figure 13A:
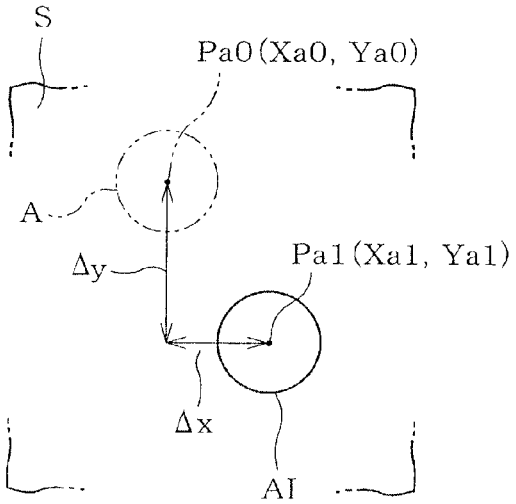
FIGS. 13A and 13B are examples of enlarged views explaining x-difference Δx and y-difference Δy between processing data and machining marks.
Figure 13B:
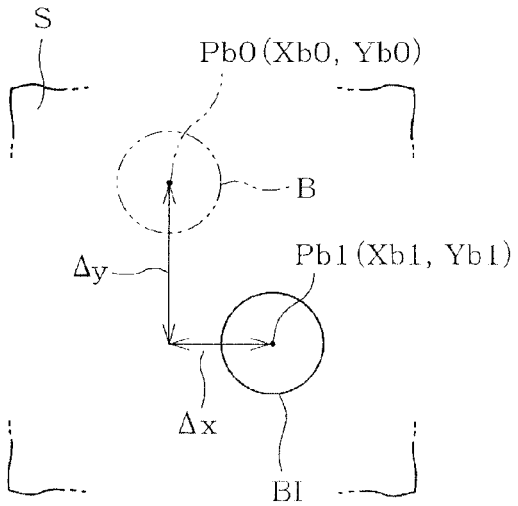

Furthermore, assume that Y coordinates of the center points $Pa_1$ and $Pb_1$ extracted from the image data correspond with each other ($Ya_1 = Yb_1$) as shown in FIGS. 13A and 13B in enlarged forms. Even in this case, the control circuit 71 calculates second correction data from the center points $Pa_1$ and $Pb_1$ and center points $Pa_0$ and $Pb_0$ of the cutting data. In this case, x-difference $\Delta x$ and y-difference $\Delta y$ are obtained between coordinate ($Xa_1$, $Ya_1$) of center point $Pa_1$ based on the image data of FIGS. 13A and 10 coordinate ($Xa_0$, $Ya_0$) of center point Pa0 in the cutting data. The differences $\Delta x$ and $\Delta y$ are stored in the correction data storage area 735 as transform values. The transform values correspond to second correction data used in the affine transform to translate the image SI.

Figure 11:
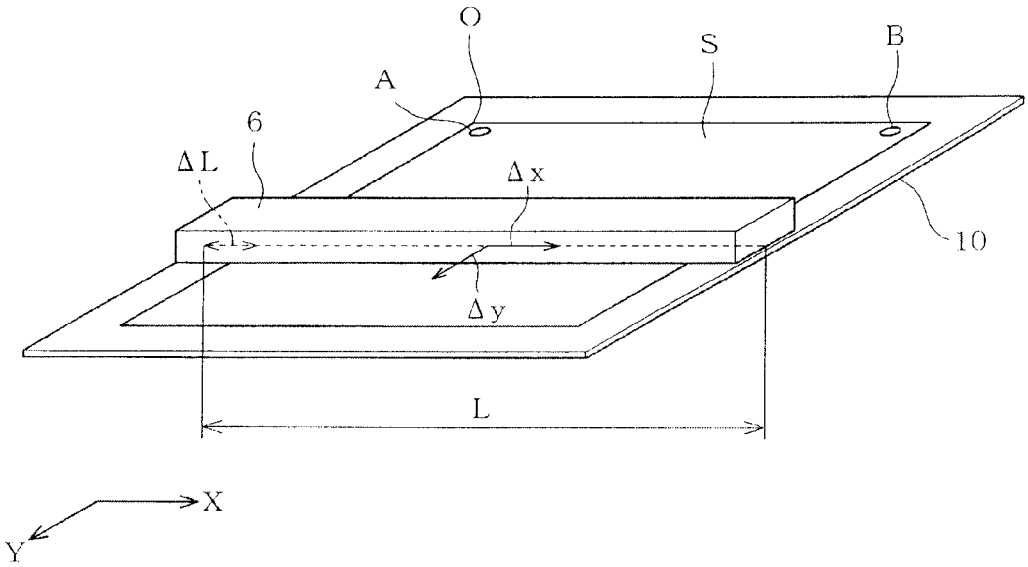
FIG. 11 schematically illustrates examples of the object and the scanner during image reading.
Figure 12A:
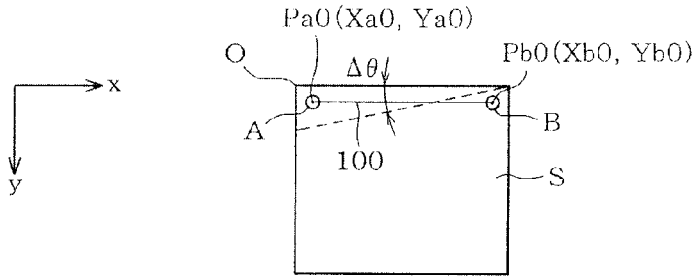
FIGS. 12A and 12B are examples explaining the object and a read image which is inclined by Δθ.
Figure 12B:
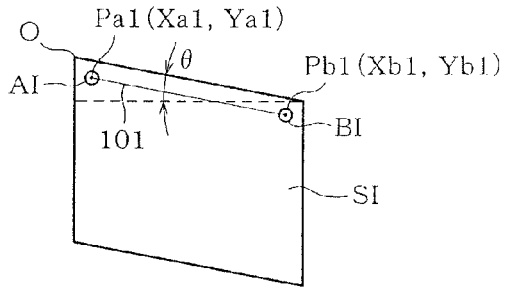

Furthermore, the control circuit 71 calculates third correction data from a ratio between the set length (the distance between $Pa_0$ and $Pb_0$) and the actual array length (the distance between $Pa_1$ and $Pb_1$) regarding the difference $\Delta L$ between the set length L in the array direction of the imaging devices as shown in FIG. 11 and the actual array length. In this case, the ratio represented as [L:(L−$\Delta$L)] is stored as a transform value in the correction data storage area 735. This transform value corresponds to third correction data used in the affine transform enlarging and reducing the image SI in the X direction as the array direction.

The affine transform enlarging and reducing the image SI, translation of the image SI and transform of the image SI from the parallelogram to the rectangle is shown by the following equation (2) using the transform matrix M:

$$(X', Y', 1) = M(X, Y, 1) \quad (2)$$

where X and Y are coordinates before transform and X' and Y' are coordinates after transform. The transform matrix M is a known three-by-three matrix. Although the first to third correction data are transform values contained in the transform matrix M, the data may be transform matrix M calculated by the control circuit 71.

Upon completion of correction data calculation, the holding sheet 10 is transferred forward by the transfer mechanism 7 to be discharged (step S27). In this case, when the user touches the touch panel 9*c* to select the processing mode or the scan and processing mode, the processing can be continuously executed (YES at step S28; and return to step S4 in FIG. 14). On the other hand, when the processing is to be finished (NO at step S28), the control circuit 71 stores the aforementioned correction data in the non-volatile storage unit such as the EEPROM 74 (END).

Thereafter, the object S affixed with a triangular pattern T as exemplified in FIG. 1 is processed in the scan and processing mode. The user then sets the holding sheet 10 affixed with the object S on the processing apparatus 1 (step S4). In the scan and processing mode (YES at step S5), the control circuit 71 instructs the scanner 6 to carry out a reading operation. Image data of the object S is obtained by the reading operation (step 310).

In this case, assume that an inclined and horizontally extending image SI differing from the actual object S as shown in FIG. 16A is obtained. The control, circuit 71 carries out correction (affine transform) of the image data using the first correction data including a correction angle of tan $\Delta\theta$ and a scale factor of cos $\Delta\theta$ in the X direction (step S11). As a result, the image SI of parallelogram is transformed to the image SI of rectangle (see FIG. 16C) and the image is scaled down by the scale factor of cos $\Delta\theta$ in the X direction. This can obtain the same image SI as the image obtained in the case where there is no error $\Delta\theta$ (see FIGS. 16A and 16D). The affine transform using the transform matrix M should not be limited to the examples of FIGS. 16A to 16D but may carry out transform including translation, and enlargement and reduction. The image data thus corrected is stored in the image display data storage area 736 of the RAM 73 (step S12).

When the cutting has been selected (YES at step S13), the control circuit 71 generates cutting data based on the corrected image data (step S14). In this case, the control circuit 71 processes the image data by a known image processing technique thereby to extract line segments L1, L2 and L3 composing an outline of the pattern T (see FIG. 16D). The control circuit 71 then sets cutting line data on the basis of the extracted line segments L1 to L3. The cutting line data includes first coordinate data, second coordinate data, third coordinate data and fourth coordinate data corresponding to a cutting start point $T_0$, apex $T_1$, apex $T_2$ and cutting end point $T_3$ respectively. The control circuit 71 further affixes the delimiter data to the end of the cutting line data and generates and adds cutting line display date, thereby generating cutting data of the pattern T. The control circuit 71 instructs the RAM 73 to store the generated cutting data in the second processing data storage area 738.

When printing has been selected at step S1 (NO at step S13), printing data is generated on the basis of the corrected image data in the same manner as the above-described cutting data (step S15). The generated printing data includes printing line data composed of coordinate data in which the start and end points of the line segments L1 to L3 are represented by X-Y coordinates and display data. The printing data is stored in the second processing data storage area 738 of the RAM 73.

The control circuit 71 generates synthetic image data in which the pattern T is superposed on the image SI of the object S. Based on the generated synthetic image data, the control circuit 71 instructs the display 9*a* to display the object S and the pattern T in the corrected form (steps S16 and S17).

Assume now that the cartridge 4 corresponding to cutting or printing data generated at step S14 or S15 is attached. In this case, when receiving the instruction to start processing by the operation of the switch of the operation device 9*b*, the control circuit 71 executes a processing operation based on the cutting or printing data (steps S18 and S19). The cutting or printing data is defined by the coordinate system of the processing apparatus 1 with the origin O of the holding sheet 10 serving as a reference point and is generated based on the image data corrected at step S11. Accordingly, high precision cutting or printing can be applied to the pattern T affixed to the object S without deviation. Consequently, the pattern T can be accurately cut out of the object S or drawing can be carried out accurately along the pattern T.

When completing processing of the object S, the control circuit 71 instructs the transfer mechanism 7 to transfer the holding sheet 10 forward and discharge the holding sheet 10 (step S20). The sequence of processing ends with the discharge of the holding sheet 10 (END). The correcting process based on the first to third correction data may be carried out for cutting data (or printing data) generated from image data which has not been corrected.

As described above, after the object S has been processed by the processing operation at step S23, the control circuit 71 calculates the difference between the actual relative position of the processing position of the processing head 5 and the array position of the imaging devices and the set relative position, based on the image data of processing mark read by the reading operation at step S24 and processing data. The control circuit 71 then corrects at least one of the image data or the processing data based on the obtained difference.

According to the above-described configuration, the control circuit 71 serving as the calculation unit calculates the difference between the actual relative position of the processing position of the processing head 5 and the array position of the imaging devices and the set relative position. Accordingly, even when the assembled positions of the head moving mechanism 8 and the imaging devices, and the like have the errors $\Delta\theta$, $\Delta z$, $\Delta y$ and $\Delta L$, the errors are calculated as the differences by the calculation unit. At least one of the image data and the processing data is corrected by the control circuit 71 serving as the correction unit on the basis of the obtained differences. The correction can resolve the deviation of the image of the object S resulting from the above-mentioned errors and the deviation of the processing position relative to the object S easily and reliably.

The calculation unit calculates the difference between in the angle made by the movement direction of the processing head 5 of the head moving mechanism 8 and the array direction of the imaging devices. The processing head 5 is moved in the direction intersecting with the transfer direction of the transfer mechanism 7 as described above. The imaging devices are also arranged in the direction intersecting with the transfer direction. Accordingly, when the differences pertaining to the movement direction of the processing head 5 and the array direction of the imaging devices are calculated, an inclination $\Delta\theta$ of the head moving mechanism 8 or the array of the imaging devices relative to the normal position (set relative position) can be accurately calculated. This can improve the precision in the correction of inclination of the image data and the processing data.

The image reading unit (the scanner 6) reads the processing mark along the array direction of the imaging devices. The calculation unit calculates the difference between the length of the processing mark in the array direction read by the image reading unit and the set length L in the array direction of the imaging devices, based on the processing data. According to this configuration, even when the actual array length of the imaging devices contains the error $\Delta L$, the error is calculated as the difference relative to the set length L, and the image data and the processing data can be corrected. Accordingly, the scale factor changed in the array direction by the reading operation of the image red unit can be corrected with respect to the image data and the processing data.

The display unit is provided which displays an image based on the image data and/or the processing data both corrected by the correction unit. According to this configuration, a correct image without position deviation can be displayed by the display unit.

The processing head 5 includes the printing unit which prints on the object S. As a result, a high-precision printing can be applied to the object S on the basis of the corrected processing data.

Figure 17:
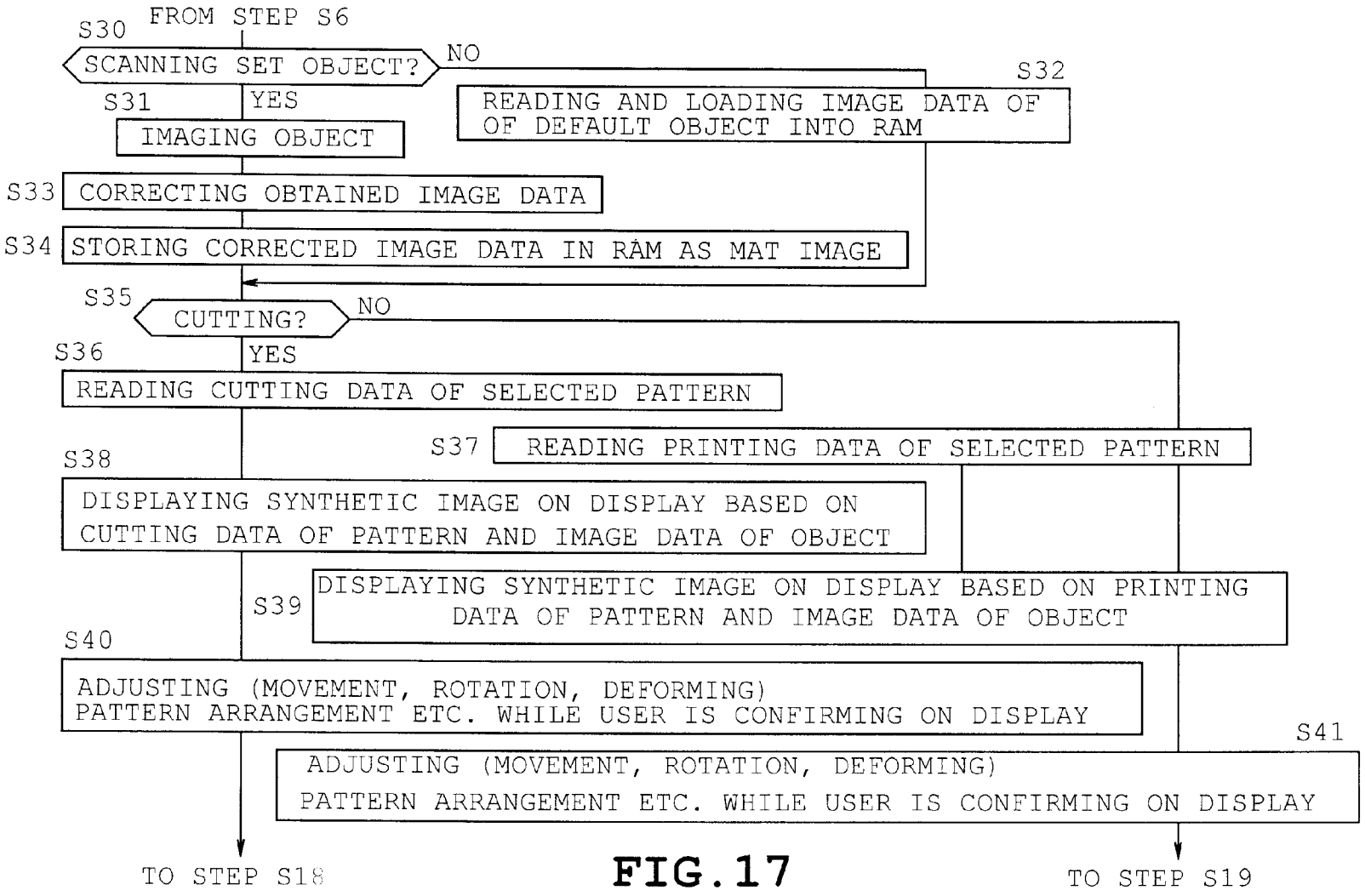
FIG. 17 is a flowchart showing a flow of processing with part thereof being changed.

A modified form of the above-described example will now be described with reference to a flowchart of FIG. 17. In the modified form, processing is executed in different manners in steps S7 to S9, S16 and S17 shown in FIG. 14. FIG. 17 shows only steps 30 to S41 in which processing is executed in the different manners, for the sake of simplification of the description. More specifically, steps S30 to 341 are executed instead of steps S7 to S9, S16 and S17. Regarding the pattern selected in the processing mode, whether or not the image of the object S which is displayed with the selected pattern is scanned can be selected at step S30 in FIG. 17. For example, the user touches the touch panel 9*c* on the pattern selecting screen to select "scanning the object S" together with selection of the pattern (YES at step S30).

In this case, the control circuit 71 instructs the scanner 6 to carry out a reading operation. As a result, image data of the object S is obtained (step S31). It is assumed that the image SI of the object S obtained in this case differs from the actual object S in the shape, for example, has an inclination as described above, or the like. The control circuit 71 then corrects the obtained image data using the first correction data (step S33). As a result, the image data is corrected into the image SI which is the same as the image in the case where there is no error $\Delta\theta$. The corrected image data is stored in the image display data storage area 736 of the RAM 73 (step S34).

On the other hand, when "scanning the object S" is not selected, (NO at step S30), the image data of the object stored in the ROM 72 is read to be loaded into the image display data storage area 736 (step S32). The image data is a default image which represents a standard size of the object S (the same size as the object S in FIG. 1) and a plain object without pattern. Accordingly, the image data need not be corrected by the first correction data.

When the cutting has been selected at step S1 (YES at step S35), the cutting data of the corresponding pattern is read from the external memory 75 to be loaded into the first processing data storage area 737 of the RAM 73 (step S36). Furthermore, the control circuit 71 generates composite image data, based on the read cutting data of the pattern and the image data stored in the image display data storage area 736. The composite image is generated by superposing the pattern on the image of the object S at the cutting position indicated by the cutting data. As a result, the composite image of the object S and the selected pattern is displayed on the display 9*a* on the basis of the generated composite image data (step S38). Furthermore, while viewing the screen of the display 9*a*, the user can operate one or more switches of the operation device 9*b* and the touch panel 9*c* to freely change the arrangement of the pattern on the object S and the like (step S40). In this case, the image of the object S displayed on the display 9*a* is the image corrected at step S33 or the default image which need not be corrected. Accordingly, even when the coordinates of the cutting data are designated regarding translation, enlargement and reduction, rotation of the pattern, and the like, no deviation relative to the object S results from the aforesaid errors $\Delta\theta$, $\Delta x$, $\Delta y$ and $\Delta L$. The translation, enlargement and reduction, rotation of the pattern, and the like can be carried out by the known affine transform.

Furthermore, when the printing has been selected (NO at step S35), composite image data is generated to be displayed on the display 9*a* in the same manner as in the above-described cutting (steps S37 and S39). The composite image data is generated on the basis of printing data of the corresponding pattern and the image data corrected at step S33 or the default image data. As a result, the arrangement of the pattern on the object S, and the like can be adjusted regarding the printing data to suite the use's taste (step S41).

Thus, with adjustment of pattern arrangement or the like at steps S40 and S41, the coordinate data of the cutting or printing data is transformed. Accordingly, the cutting or printing can be executed at step S18 or S19 on the basis of the corrected cutting or printing data.

The foregoing examples should not be restrictive but may be modified or expanded as follows. Although the disclosure is applied to the processing apparatus in the foregoing examples, the disclosure may be applied to various apparatuses provided with a cutting unit and/or a printing unit.

The image acquisition unit should not be limited to the CIS (the scanner 6). A charge-coupled device (CCD) may be used as the image acquisition unit. This case can achieve the same advantageous effects as the foregoing examples. The correction unit may be configured to carry out correction based on an amount of deviation calculated by a calculation unit instead of the correction based on the first to third correction data. For example, a correcting process may be carried out with the difference calculated at step S25 serving as a shift amount (movement amount), instead of the correction by the affine transform. In this correction process, coordinate data contained in the cutting data (or the printing data generated at step S15) generated at step S14 is transformed.

Furthermore, the calculation processing data used in calculation of the difference should not be limited to the cutting data of the patterns A and B. For example, printing data may be used as the calculation processing data. The printing data is used to draw a straight line having a start point ($Pa_0$) which is one end of the aforesaid imaginary line segment 100 (see FIG. 12A) and an end point ($Pb_0$) which is the other end of the imaginary line segment 100. In this case, the straight line is drawn on the object S by the pen P by moving the processing head 5 in the X direction while the transfer of the holding sheet 10 by the transfer mechanism 7 is stopped. Accordingly, the difference can be exactly calculated using the image data of the straight line and the relatively easy processing data (printing data), with the result that the precision of the correction can be improved.

The data processing program stored in the storage unit of the processing apparatus 1 may be stored in a non-transitory computer-readable storage medium including a USB flash memory, CD-ROM, flexible disc, DVD and flash memory. In this case, when the data processing program stored in the storage medium is read by computers incorporated in various processing apparatuses provided with a cutting unit and/or a printing unit thereby to be executed, the same advantageous effects as achieved by the above-described examples can be achieved by these processing apparatuses.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

What is claimed is:

1. An apparatus comprising:

a cartridge holder configured to receive a pen or a cutter;

a platen configured to receive an object;

a first moving mechanism configured to move the cartridge holder in a direction that the cartridge holder comes close to the platen;

a reading unit configured to read image data from the object;

a second moving mechanism configured to move the object to the reading unit;

a memory configured to store processing data including calculation processing data for moving the first moving mechanism, the processing data serving as instructions to the apparatus; and a processor configured to instruct the apparatus to:

instruct the first moving mechanism to move the cartridge holder close to the platen, based on the calculation processing data;

instruct the second moving mechanism to move the object to the reading unit and the reading unit to read image data, after instructing the first moving mechanism to move the cartridge holder close to the platen based on the calculation processing data;

extract, from the image data, a processing mark on the object;

calculate a rotation angle for correcting the image data, based on the processing mark; and correct, based on the rotation angle, at least one of the image data and the processing data.

2. The apparatus according to claim 1, wherein the processor is further configured to instruct the apparatus to:

instruct the first moving mechanism to move the cartridge holder, based on the image data corrected based on the rotation angle or the processing data corrected based on the rotation angle; and instruct the second moving mechanism to move the objet, based on the image data corrected based on the rotation angle or the processing data corrected based on the rotation angle.

3. The apparatus according to claim 1,
wherein the calculating the rotation angle comprises:
extracting, from the image data, two processing marks on the object; and
calculating the rotation angle based on the two processing marks.

4. The apparatus according to claim 1,
wherein the calculating the rotation angle comprises:
extracting, from the image data, two processing marks on the object,
calculating a length between the two processing marks based on the two processing marks; and
calculating correcting data for correcting the image data based on the length between the two processing marks and a set length; and
wherein the correcting at least one of the image data and the processing data comprises correcting at least one of the image data and the processing data, based on the rotation angle and the correcting data.

5. The apparatus according to claim 1,
wherein the calculating the rotation angle comprises:
extracting, from the image data, a first position representing a position of the processing mark on the object; and
calculating a difference between the first position and a second position which is a normal position represented by the calculation processing data; and
wherein the correcting at least one of the image data and the processing data comprises correcting at least one of the image data and the processing data, based on the rotation angle and the difference.

6. The apparatus according to claim 1, further comprising:
a display unit,
wherein the processor is further configured to instruct the apparatus to:
instruct the display unit to display an image based on the image data corrected based on the rotation angle or the processing data corrected based on the rotation angle.

7. A non-transitory computer-readable medium for an apparatus comprising:
a cartridge holder configured to receive a pen or a cutter;
a platen configured to receive an object;
a first moving mechanism configured to move the cartridge holder in a direction that the cartridge holder comes close to the platen;
a reading unit configured to read image data from the object;
a second moving mechanism configured to move the object to the reading unit; and
a memory configured to store processing data including calculation processing data for moving the first moving mechanism, the processing data serving as instructions to the apparatus;
wherein the computer-readable medium stores computer-readable instructions, when executed by a processor of the apparatus, cause the apparatus to:
instruct the first moving mechanism to move the cartridge holder close to the platen, based on the calculation processing data;
instruct the second moving mechanism to move the object to the reading unit and the reading unit to read image data, after instructing the first moving mechanism to move the cartridge holder close to the platen based on the calculation processing data;
extract, from the image data, a processing mark on the object;
calculate a rotation angle for correcting the image data, based on the processing mark; and
correct, based on the rotation angle, at least one of the image data and the processing data.

8. The non-transitory computer-readable medium according to claim 7, wherein the computer-readable instructions further cause the apparatus to:
instruct the first moving mechanism to move the cartridge holder, based on the image data corrected based on the rotation angle or the processing data corrected based on the rotation angle; and
instruct the second moving mechanism to move the objet, based on the image data corrected based on the rotation angle or the processing data corrected based on the rotation angle.

9. The non-transitory computer-readable medium according to claim 7,
wherein the calculating the rotation angle comprises:
extracting, from the image data, two processing marks on the object; and
calculating the rotation angle based on the two processing marks.

10. The non-transitory computer-readable medium according to claim 7,
wherein the calculating the rotation angle comprises:
extracting, from the image data, two processing marks on the object,
calculating a length between the two processing marks based on the two processing marks; and
calculating correcting data for correcting the image data based on the length between the two processing marks and a set length; and
wherein the correcting at least one of the image data and the processing data comprises correcting at least one of the image data and the processing data, based on the rotation angle and the correcting data.

11. The non-transitory computer-readable medium according to claim 7,
wherein the calculating the rotation angle comprises:
extracting, from the image data, a first position representing a position of the processing mark on the object; and
calculating a difference between the first position and a second position which is a normal position represented by the calculation processing data; and
wherein the correcting at least one of the image data and the processing data comprises correcting at least one of the image data and the processing data, based on the rotation angle and the difference.

12. The non-transitory computer-readable medium according to claim 7, wherein the apparatus further comprises:
a display unit,
wherein the computer-readable instructions further cause the apparatus to:
instruct the display unit to display an image based on the image data corrected based on the rotation angle or the processing data corrected based on the rotation angle.

13. An apparatus comprising:
a pen or a cutter;
a platen configured to receive an object;
a first moving mechanism configured to move the pen or the cutter in a direction that the cartridge holder comes close to the platen;
a reading unit configured to read image data from the object;

a second moving mechanism configured to move the object to the reading unit;

a memory configured to store processing data including calculation processing data for moving the first moving mechanism, the processing data serving as instructions to the apparatus; and a processor configured to instruct the apparatus to:

instruct the first moving mechanism to move the pen or the cutter close to the platen, based on the calculation processing data;

instruct the second moving mechanism to move the object to the reading unit and the reading unit to read image data, after instructing the first moving mechanism to move the pen or the cutter close to the platen based on the calculation processing data;

extract, from the image data, a processing mark on the object;

calculate a rotation angle for correcting the image data, based on the processing mark; and correct, based on the rotation angle, at least one of the image data and the processing data.

14. The apparatus according to claim 13, wherein the processor is further configured to instruct the apparatus to:

instruct the first moving mechanism to move the pen or the cutter, based on the image data corrected based on the rotation angle or the processing data corrected based on the rotation angle; and instruct the second moving mechanism to move the objet, based on the image data corrected based on the rotation angle or the processing data corrected based on the rotation angle.

15. The apparatus according to claim 13, wherein the calculating the rotation angle comprises:

extracting, from the image data, two processing marks on the object; and calculating the rotation angle based on the two processing marks.

16. The apparatus according to claim 13, wherein the calculating the rotation angle comprises:

extracting, from the image data, two processing marks on the object, calculating a length between the two processing marks based on the two processing marks; and calculating correcting data for correcting the image data based on the length between the two processing marks and a set length; and wherein the correcting at least one of the image data and the processing data comprises correcting at least one of the image data and the processing data, based on the rotation angle and the correcting data.

17. The apparatus according to claim 13, wherein the calculating the rotation angle comprises:

extracting, from the image data, a first position representing a position of the processing mark on the object; and calculating a difference between the first position and a second position which is a normal position represented by the calculation processing data; and wherein the correcting at least one of the image data and the processing data comprises correcting at least one of the image data and the processing data, based on the rotation angle and the difference.

18. The apparatus according to claim 13, further comprising:

a display unit, wherein the processor is further configured to instruct the apparatus to:

instruct the display unit to display an image based on the image data corrected based on the rotation angle or the processing data corrected based on the rotation angle.

* * * * *